US011352100B2

(12) United States Patent
Oh et al.

(10) Patent No.: US 11,352,100 B2
(45) Date of Patent: Jun. 7, 2022

(54) CONTAINER TRANSPORTATION SHIP

(71) Applicant: KOREA GAS CORPORATION, Daegu (KR)

(72) Inventors: Young Sam Oh, Incheon (KR); So Jin Park, Ansan (KR); Kyoung Shik Choi, Ansan (KR)

(73) Assignee: KOREA GAS CORPORATION, Daegu (KR)

( * ) Notice: Subject to any disclaimer, the term of this patent is extended or adjusted under 35 U.S.C. 154(b) by 0 days.

(21) Appl. No.: 17/230,866

(22) Filed: Apr. 14, 2021

(65) Prior Publication Data

US 2021/0309323 A1 Oct. 7, 2021

Related U.S. Application Data

(63) Continuation of application No. 16/329,627, filed as application No. PCT/KR2017/009459 on Aug. 30, 2017, now abandoned.

(30) Foreign Application Priority Data

Aug. 31, 2016 (KR) ..... 10-2016-0112020
Jul. 31, 2017 (KR) ..... 10-2017-0096935

(51) Int. Cl.
*B63B 27/00* (2006.01)
*B63B 25/16* (2006.01)
(Continued)

(52) U.S. Cl.
CPC ..... *B63B 27/00* (2013.01); *B63B 15/00* (2013.01); *B63B 17/00* (2013.01); *B63B 25/00* (2013.01);
(Continued)

(58) Field of Classification Search
CPC ..... B63B 27/00; B63B 25/28; B63B 27/12; B63B 27/14; B63B 25/008; B63B 25/04
See application file for complete search history.

(56) References Cited

U.S. PATENT DOCUMENTS 3,591,023 A * 7/1971 Allen ..... B63B 25/004 414/140.1
4,158,416 A * 6/1979 Podesta ..... B66F 9/186 414/626
(Continued)

FOREIGN PATENT DOCUMENTS

CN 102101595 A 6/2011
CN 105658515 A 6/2016
(Continued)

OTHER PUBLICATIONS

International Search Report in related PCT Application No. PCT/KR2017/009459 dated Jan. 26, 2018.
(Continued)

*Primary Examiner* — Andrew Polay

(57) ABSTRACT

The present invention relates to a container transportation ship. More particularly, the present invention relates to a container transportation ship for transporting containers, characterized in that a loading space in which at least one container is loaded and a loading/unloading space configured such that an external transfer means can directly enter/exit in order to load and unload the container, are delimited on the deck of the container transportation ship; and a crane is provided to move the container in the longitudinal direction of the container transportation ship, in the transverse direction thereof, and in the upward/downward direction thereof for the purpose of loading the container on the external transfer means that has entered the loading/unloading space or unloading the container from the external transfer means.

13 Claims, 22 Drawing Sheets

(51) Int. Cl.

| | |
|---|---|
| ***B63B 27/12*** | (2006.01) |
| ***B63B 27/14*** | (2006.01) |
| ***B63B 17/00*** | (2006.01) |
| ***B66C 23/52*** | (2006.01) |
| ***B63B 25/00*** | (2006.01) |
| ***B63B 15/00*** | (2006.01) |
| ***B63B 27/10*** | (2006.01) |
| ***B63B 35/28*** | (2006.01) |
| ***B63B 35/44*** | (2006.01) |
| ***B63B 25/04*** | (2006.01) |
| ***B63B 25/28*** | (2006.01) |
| ***B63B 27/25*** | (2006.01) |
| ***B66C 19/00*** | (2006.01) |
| ***F17C 7/04*** | (2006.01) |

(52) U.S. Cl.

CPC ..... *B63B 25/04* (2013.01); *B63B 25/16* (2013.01); *B63B 25/28* (2013.01); *B63B 27/10* (2013.01); *B63B 27/12* (2013.01); *B63B 27/14* (2013.01); *B63B 27/25* (2013.01); *B63B 35/28* (2013.01); *B63B 35/44* (2013.01); *B66C 19/007* (2013.01); *B66C 23/52* (2013.01); *F17C 7/04* (2013.01); *B63B 2025/285* (2013.01); *F17C 2221/033* (2013.01); *F17C 2270/0113* (2013.01)

(56) References Cited

U.S. PATENT DOCUMENTS

| | | | | |
|---|---|---|---|---|
| 4,803,940 | A | 2/1989 | Ebeling et al. | |
| 5,832,856 | A * | 11/1998 | Giles | B63B 25/008 440/38 |
| 6,537,009 | B1 * | 3/2003 | Le Lan | B63B 27/12 414/139.4 |
| 10,308,326 | B2 * | 6/2019 | Oh | B63B 25/008 |
| 2013/0180442 | A1 * | 7/2013 | Pedersen | B63B 25/22 211/49.1 |
| 2016/0160752 | A1 | 6/2016 | Kuhlmann | |

FOREIGN PATENT DOCUMENTS

| | | | |
|---|---|---|---|
| EP | 2098445 | A1 | 9/2009 |
| EP | 2907738 | A1 | 8/2015 |
| JP | S5935196 | U | 3/1984 |
| JP | 2013035505 | A | 2/2013 |
| KR | 20030078145 | A | 10/2003 |
| KR | 201 10064226 | A | 6/2011 |
| KR | 20110081662 | A | 7/2011 |
| KR | 101148078 | B1 | 5/2012 |
| KR | 20150053207 | A | 5/2015 |

OTHER PUBLICATIONS

Search Report and Written Opinion for European Application No. 17846982.1, dated Mar. 23, 2020.

* cited by examiner

【FIG. 1】
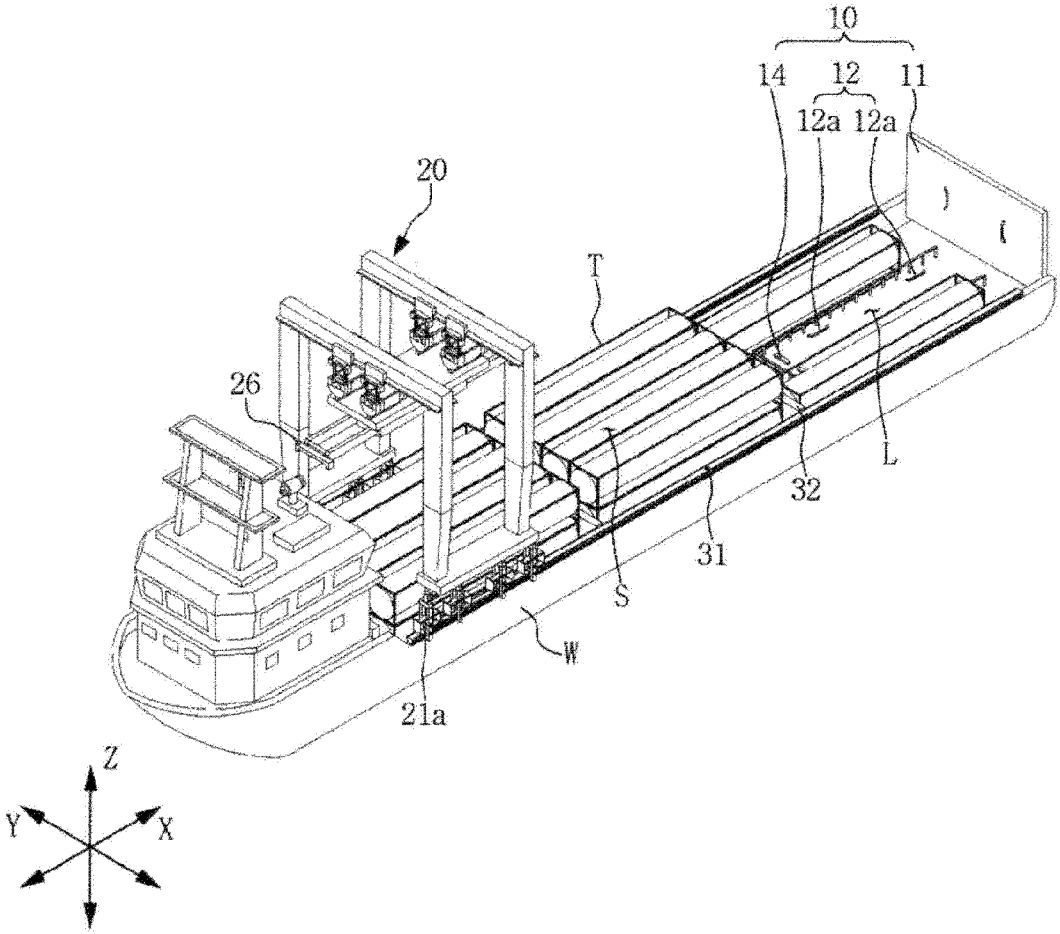

【FIG. 2】
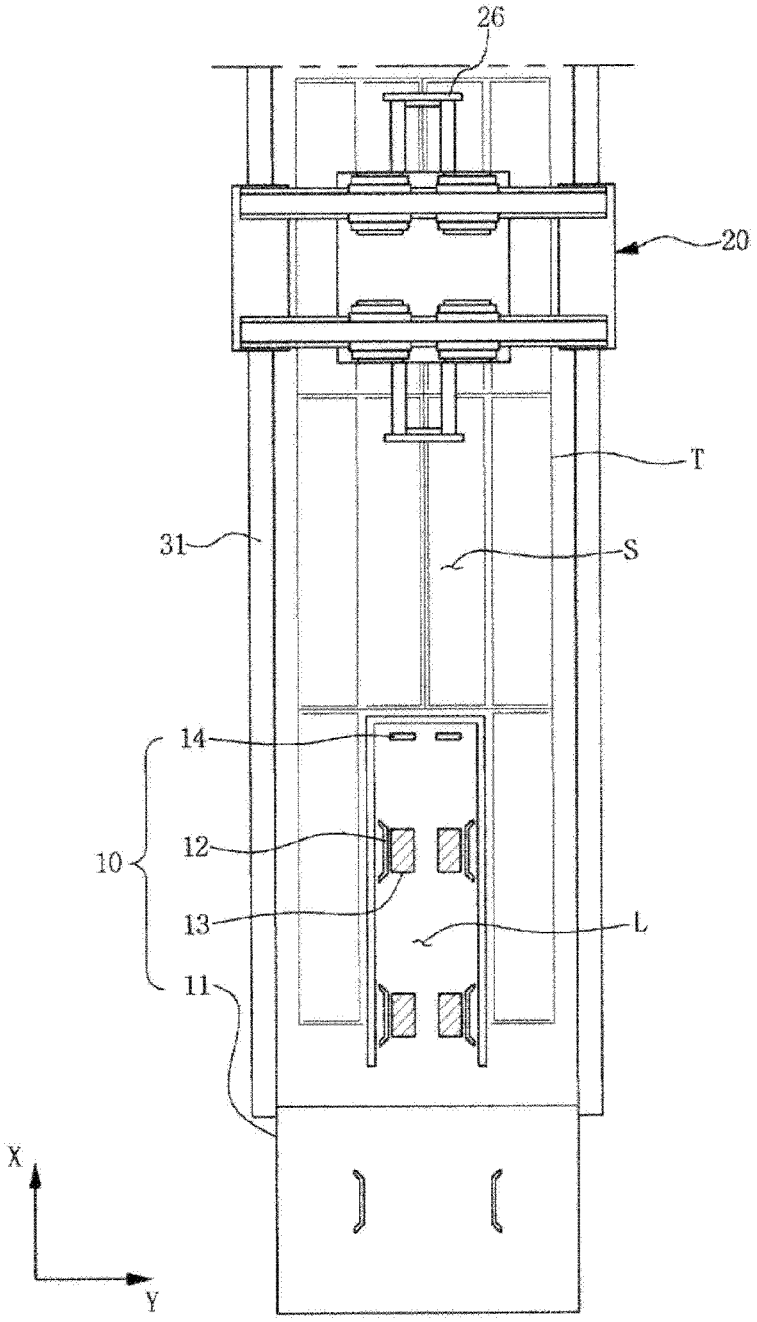

【FIG. 3】
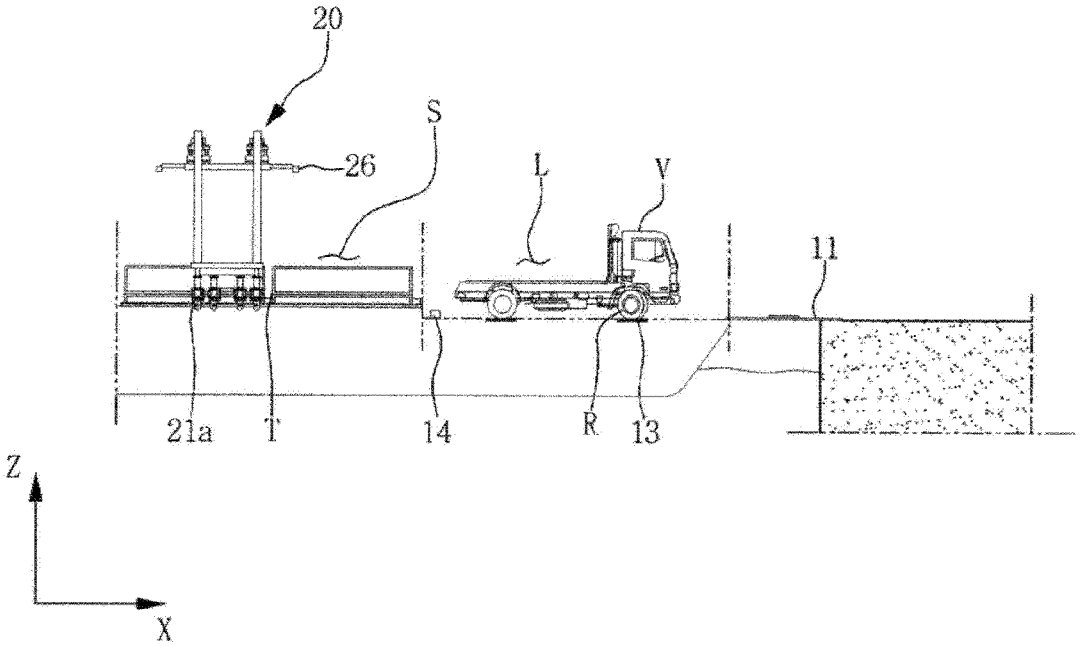

【FIG. 4】
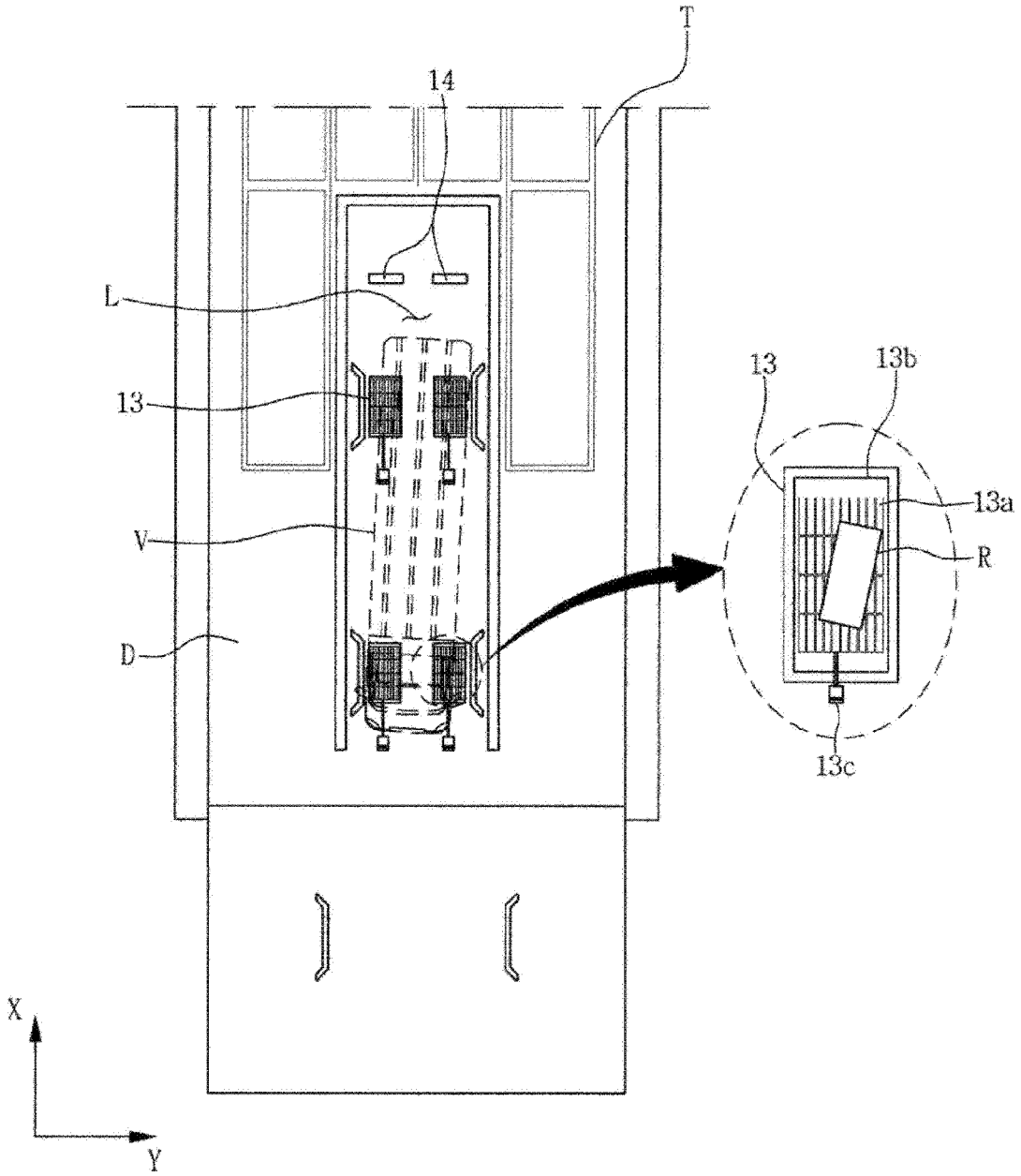

【FIG. 5】
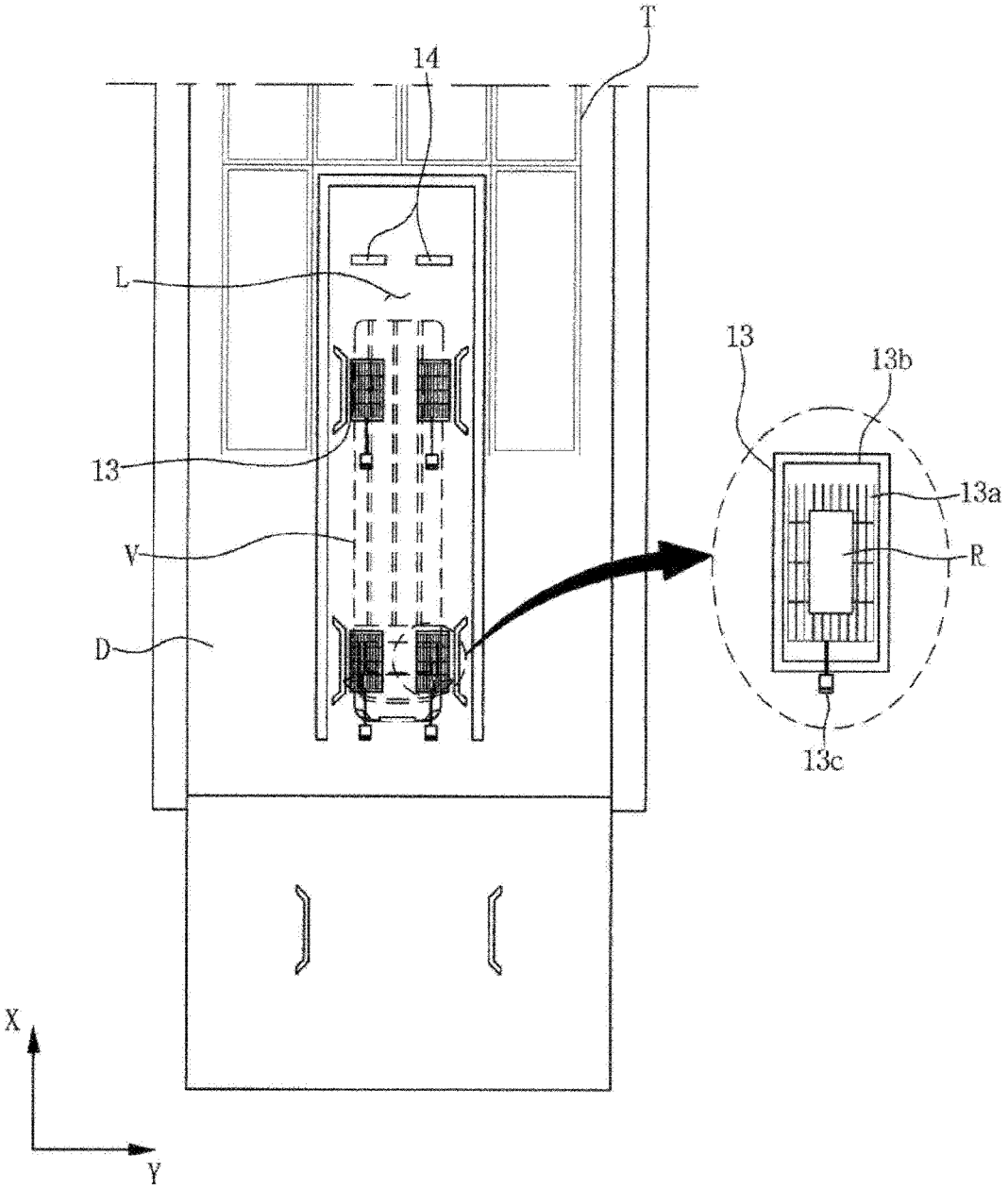

【FIG. 6】
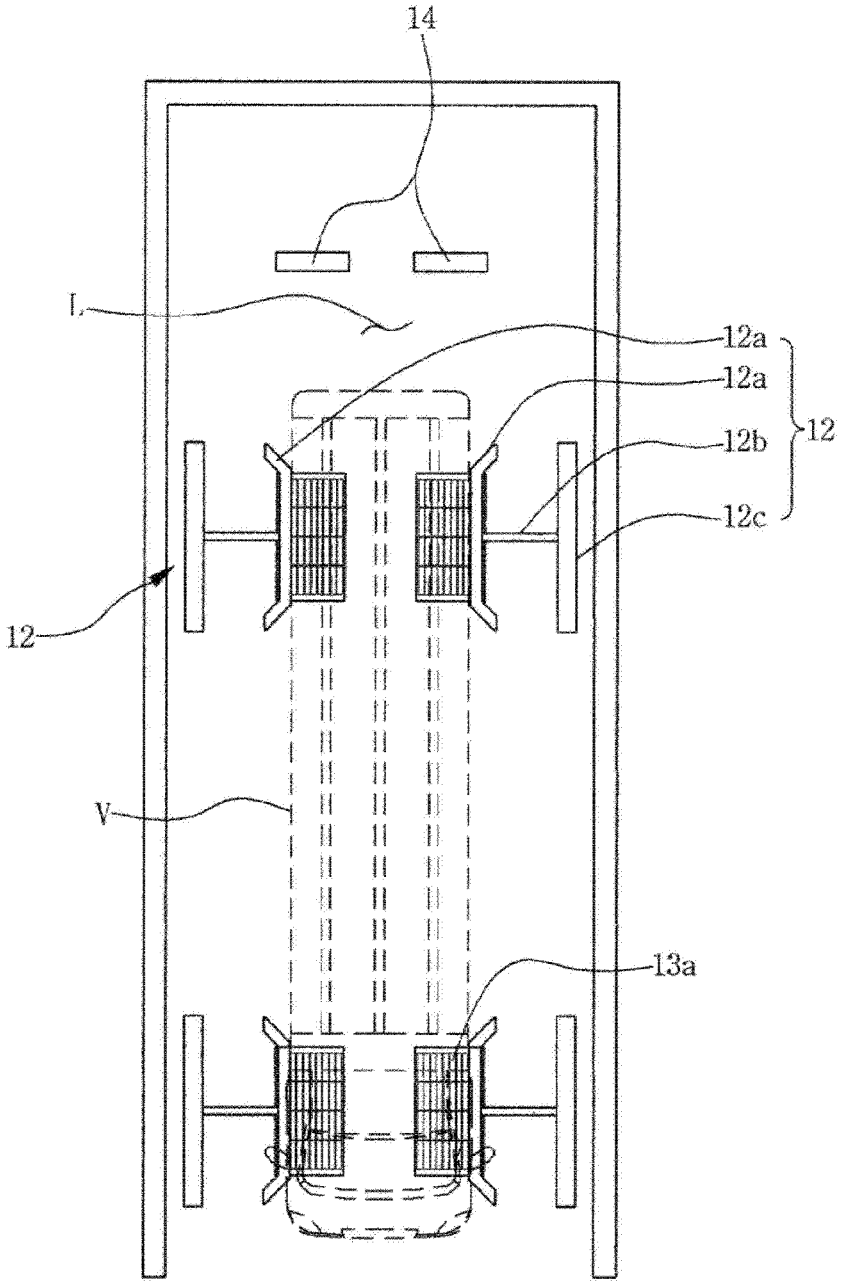

【FIG. 7】
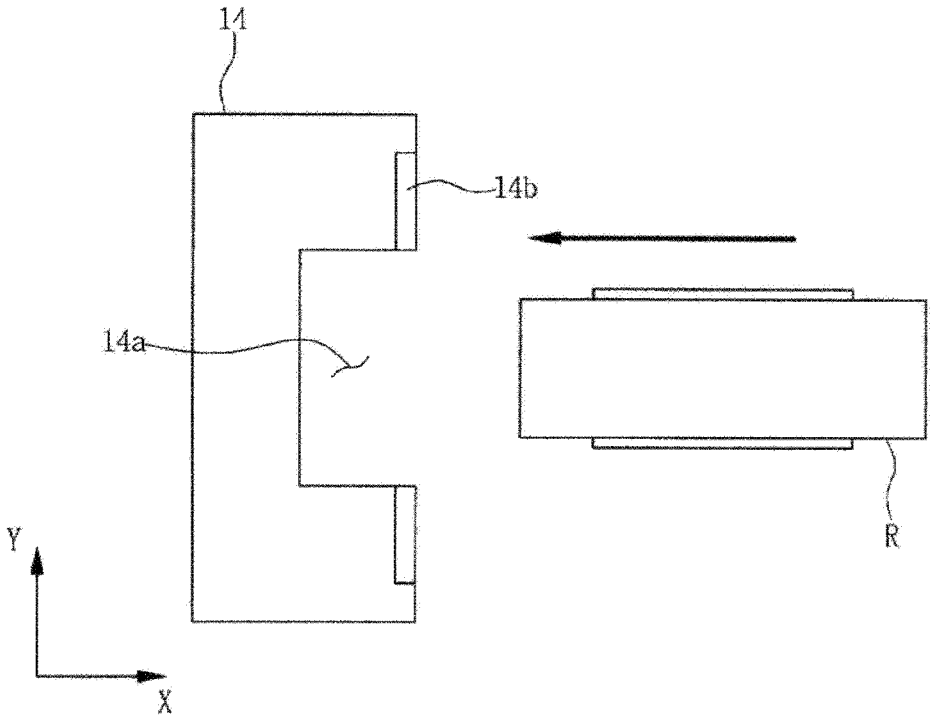
【FIG. 8】
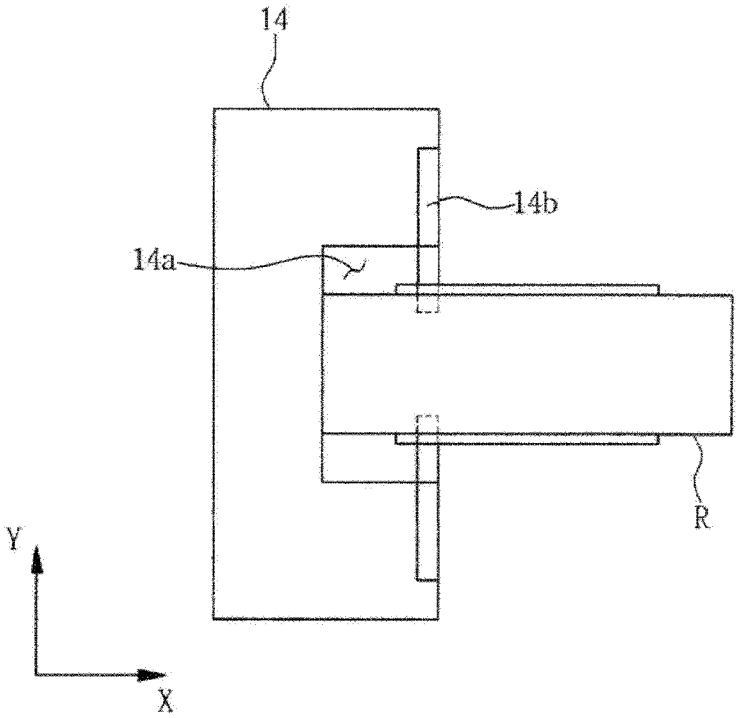

【FIG. 9】
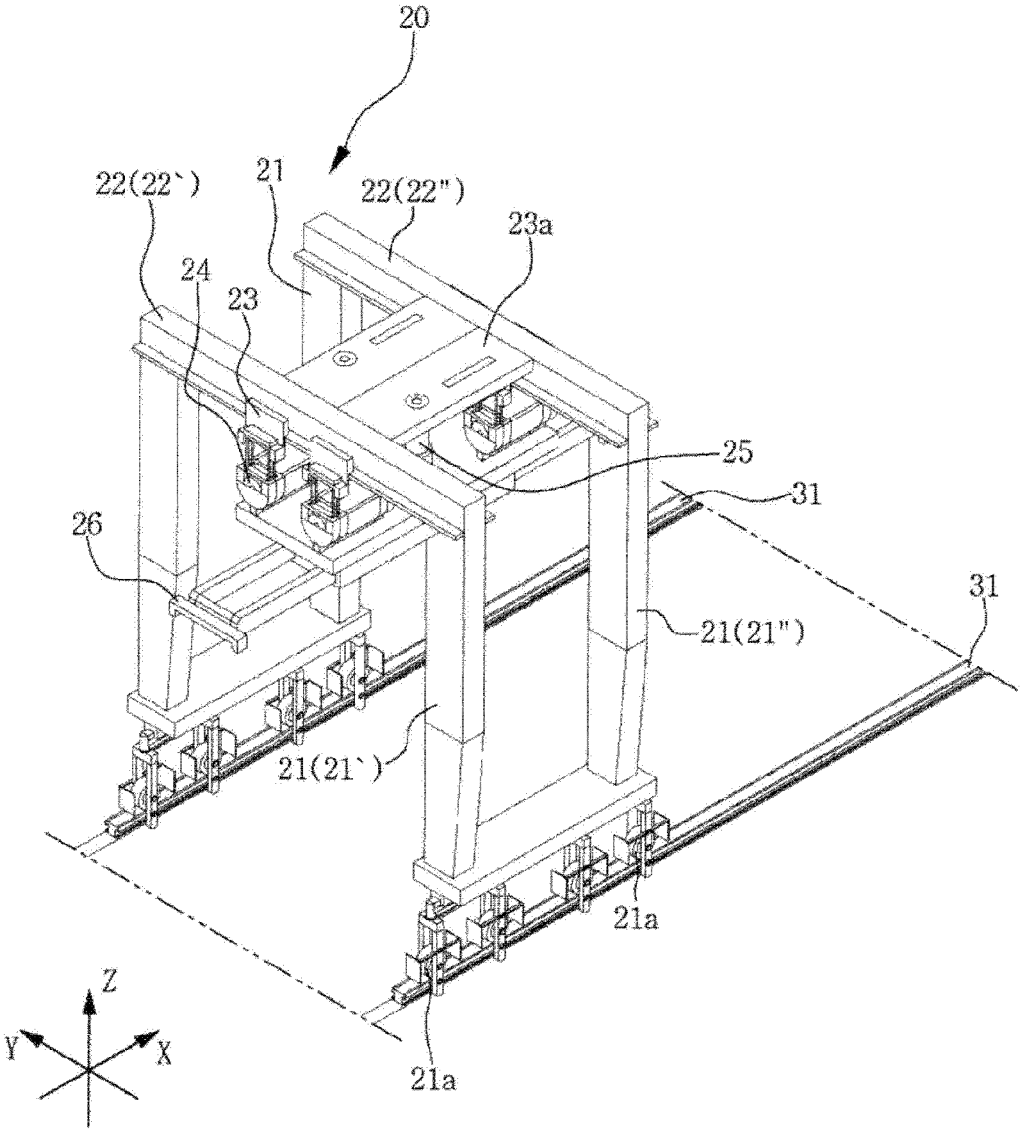

【FIG. 10】
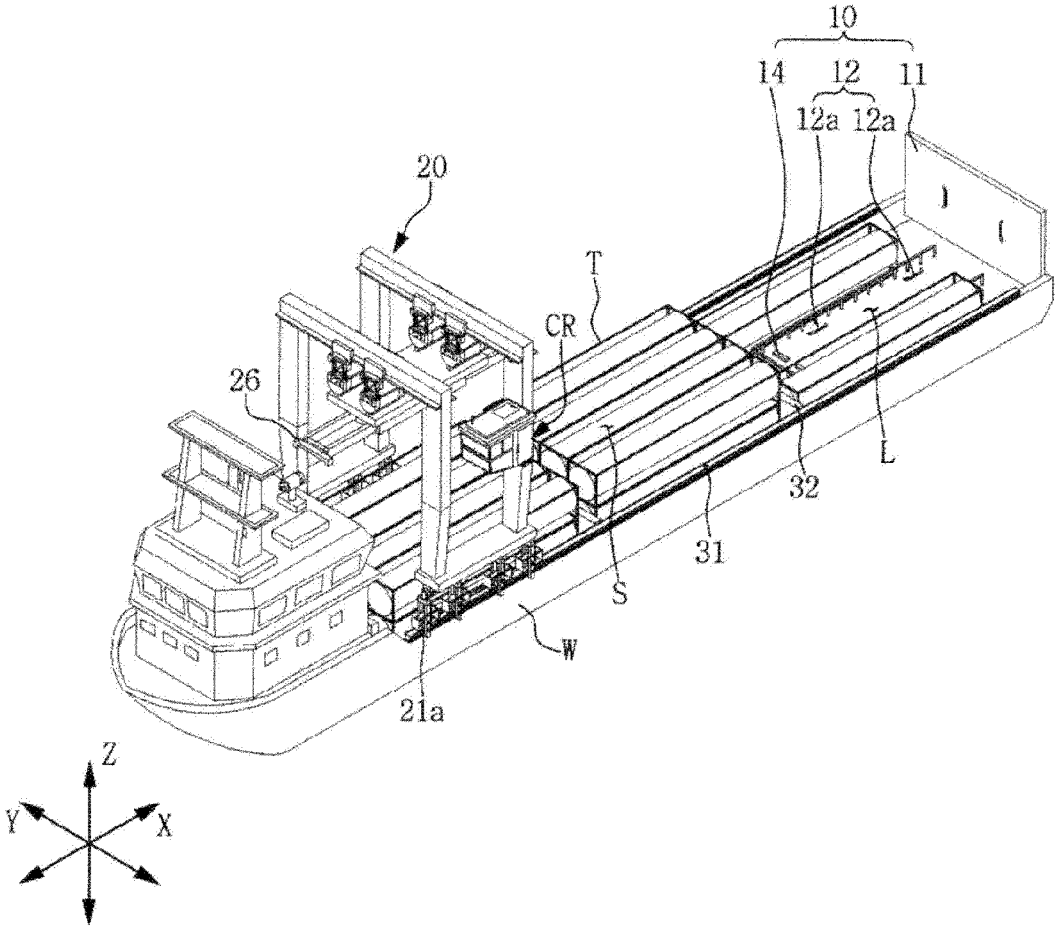

【FIG. 11】
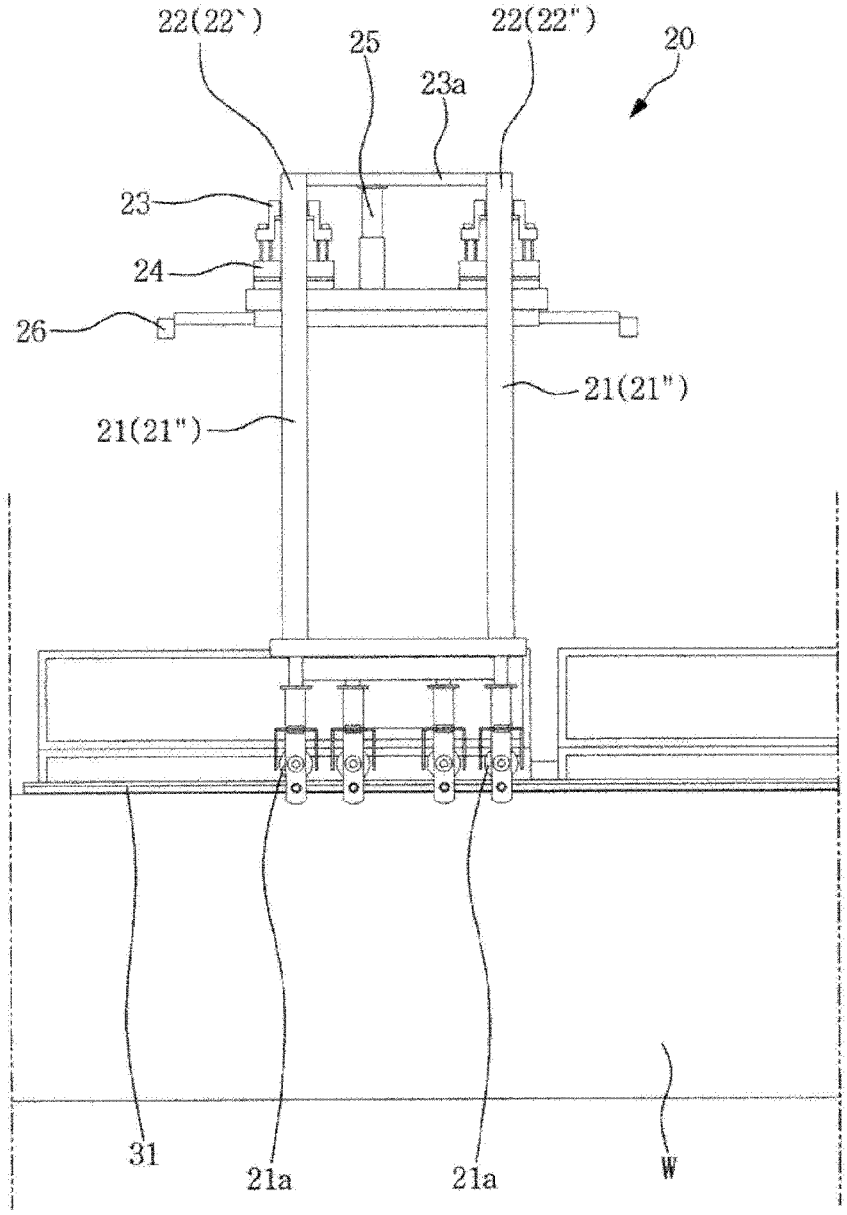

【FIG. 12】
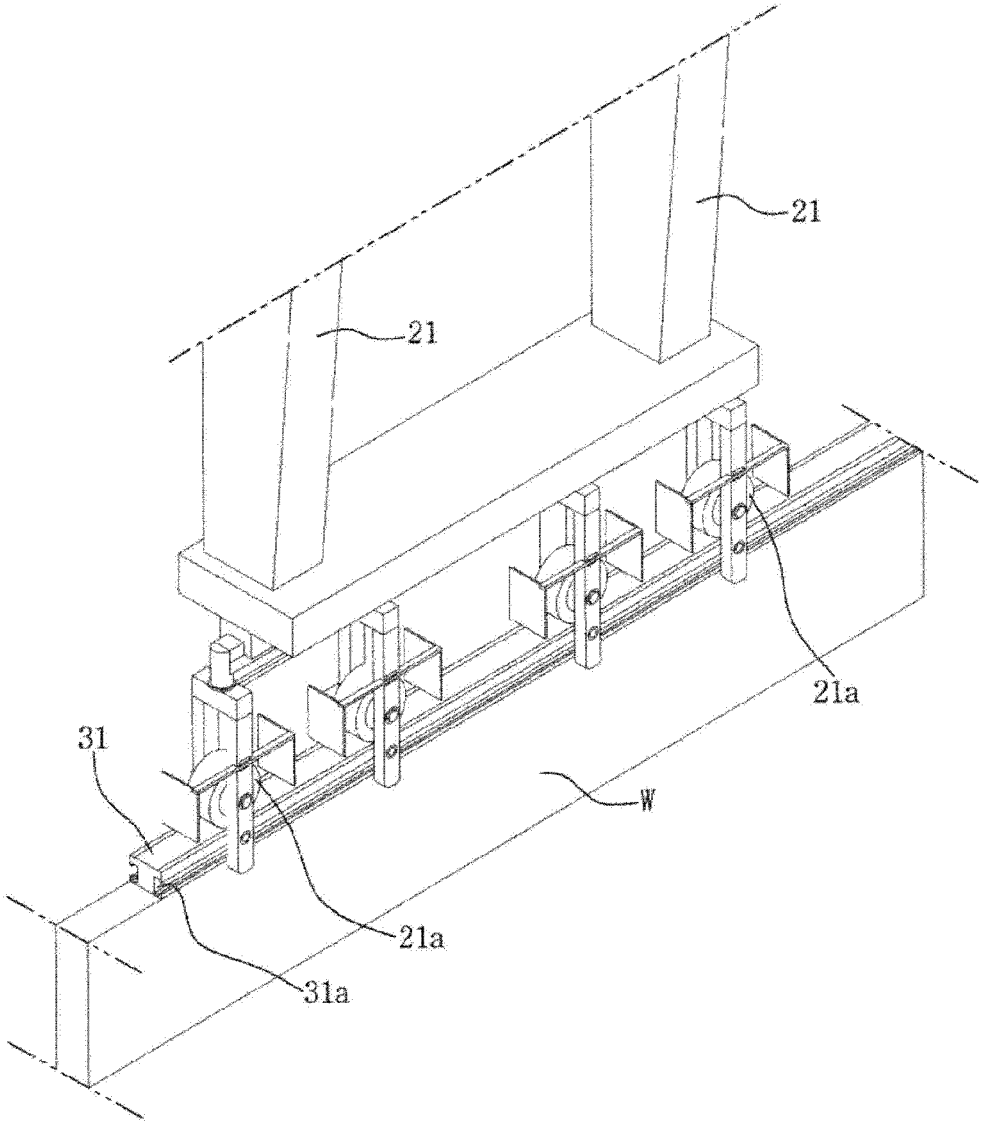

【FIG. 13】
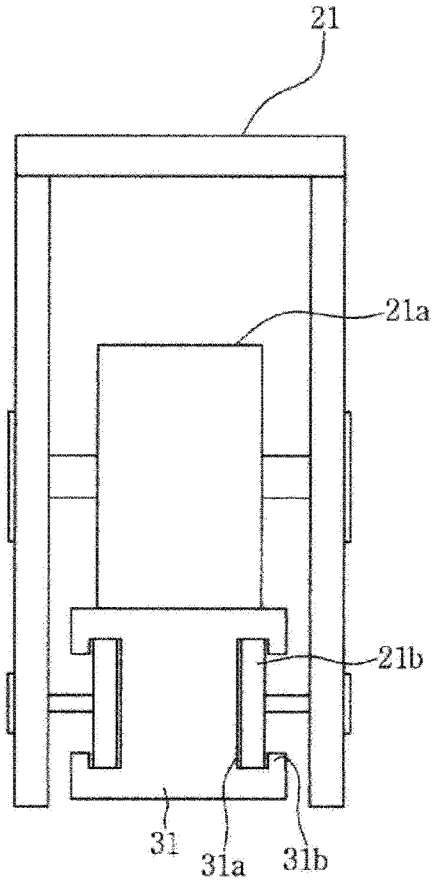

【FIG. 14】
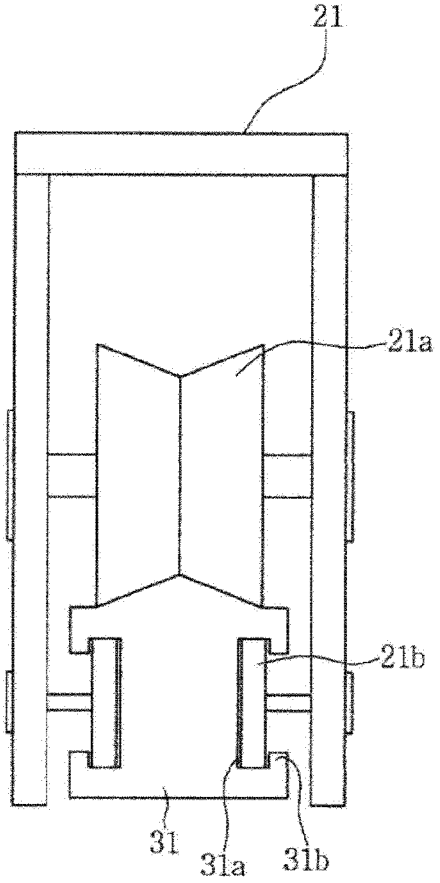

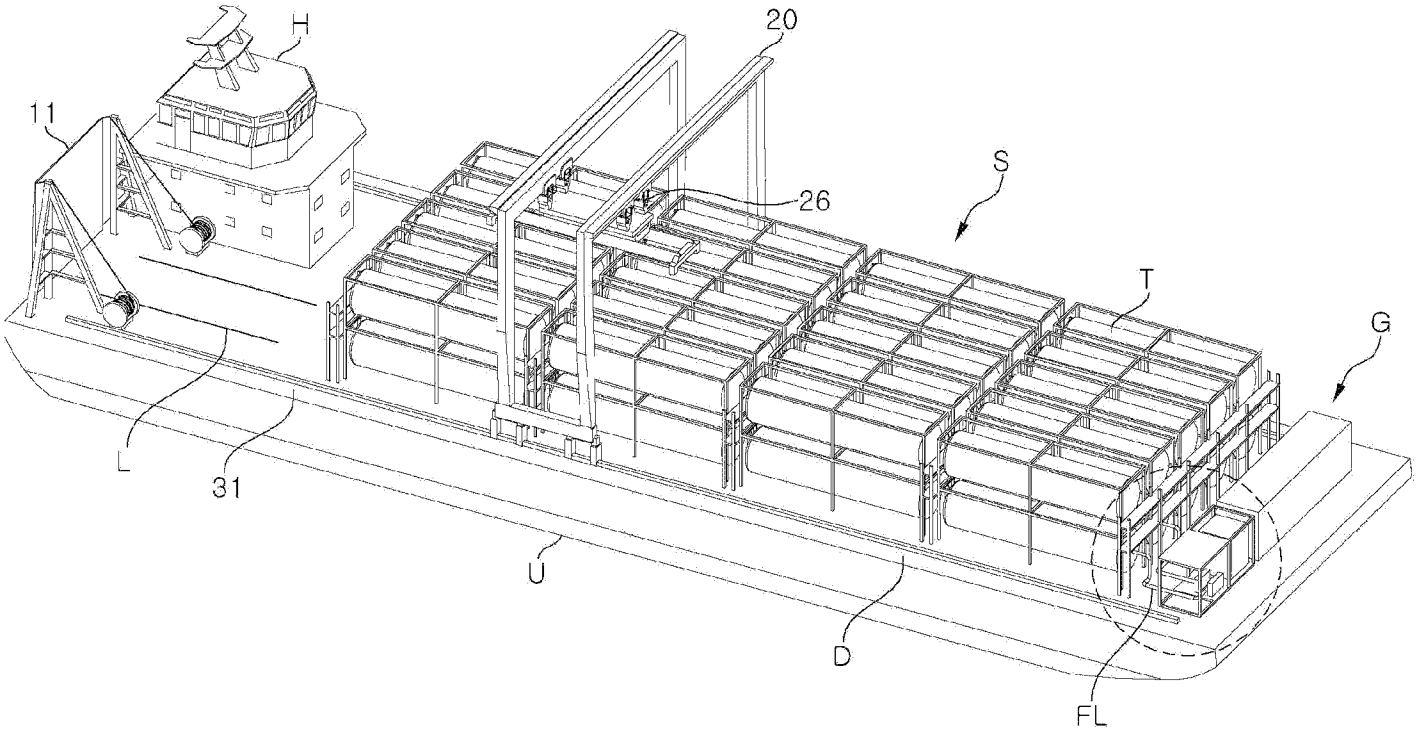
[FIG. 15]

【FIG. 16】
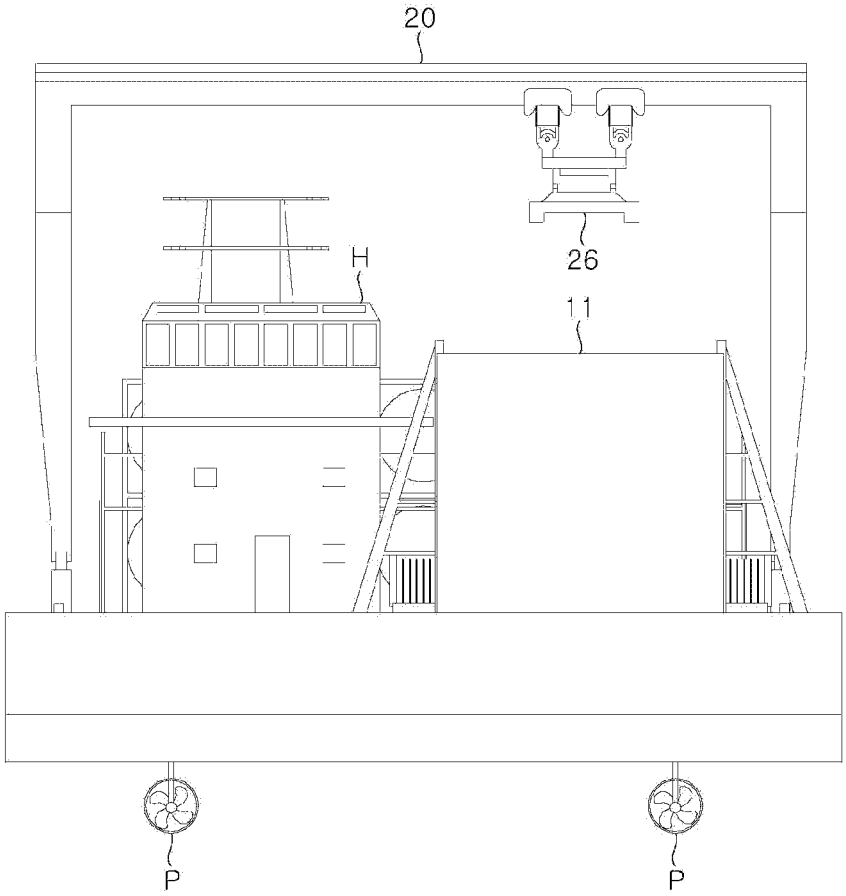

【FIG. 17】
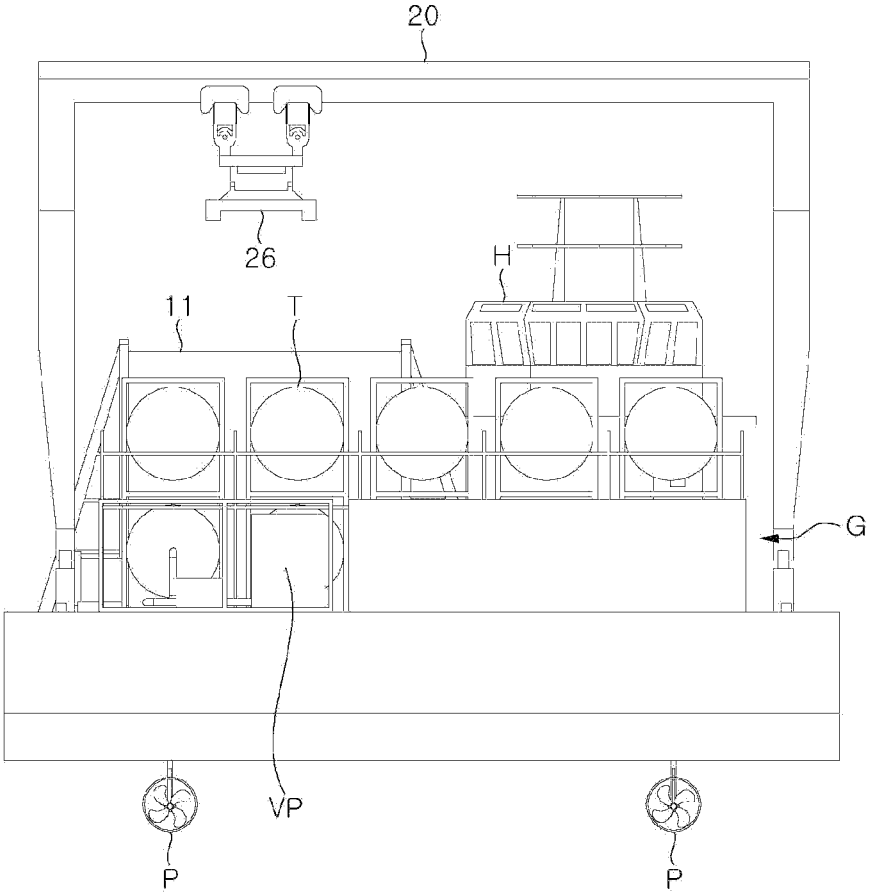

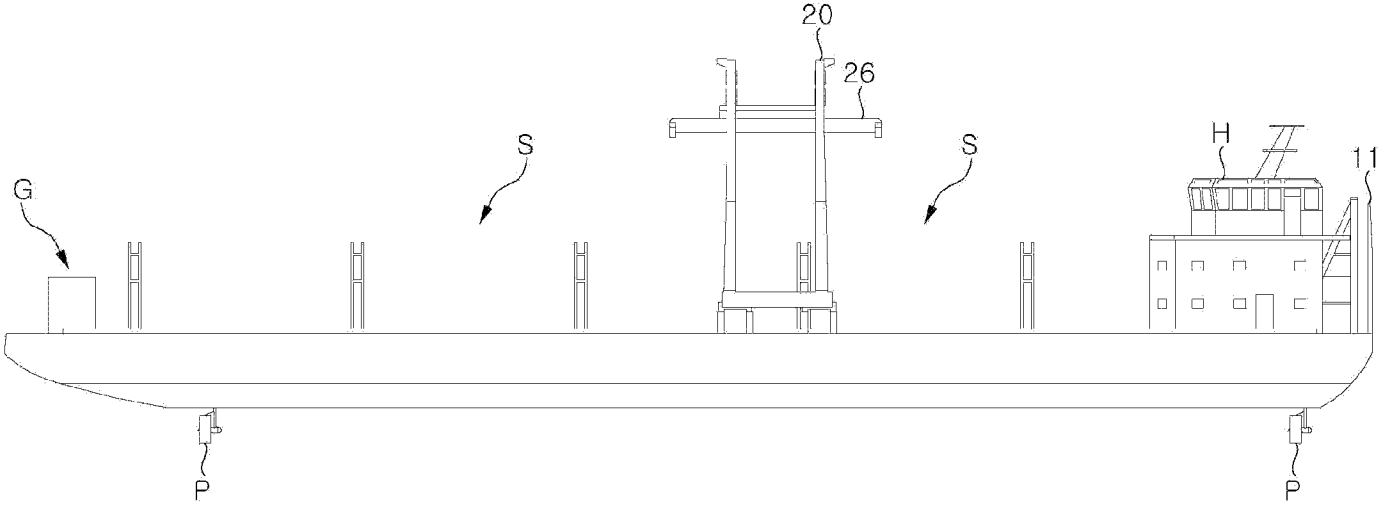
[FIG. 18]

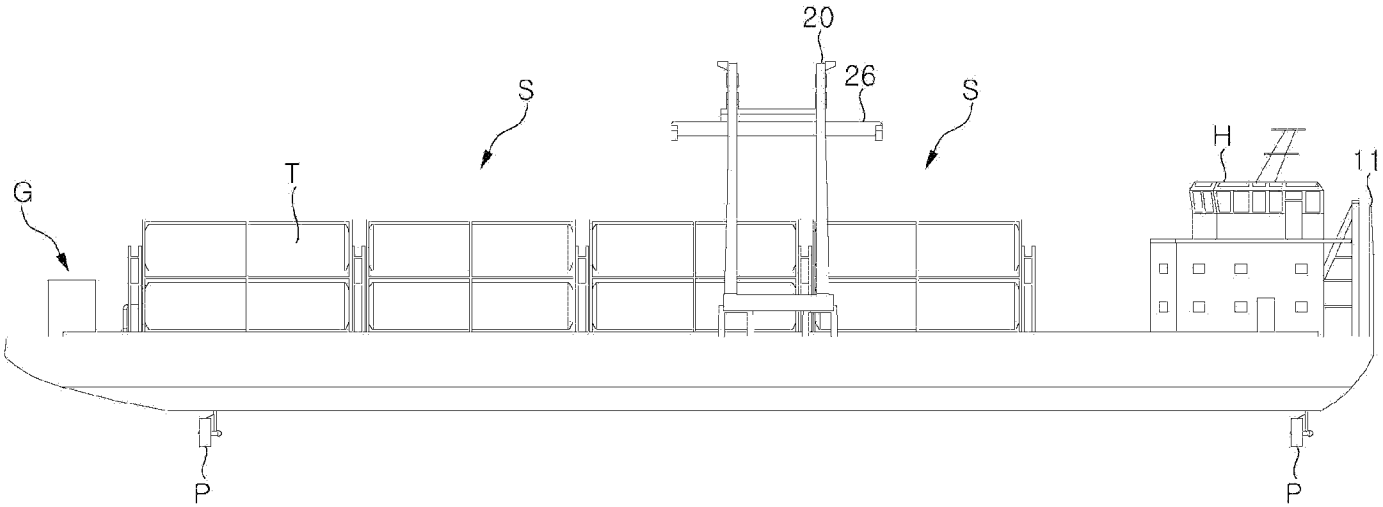
[FIG. 19]

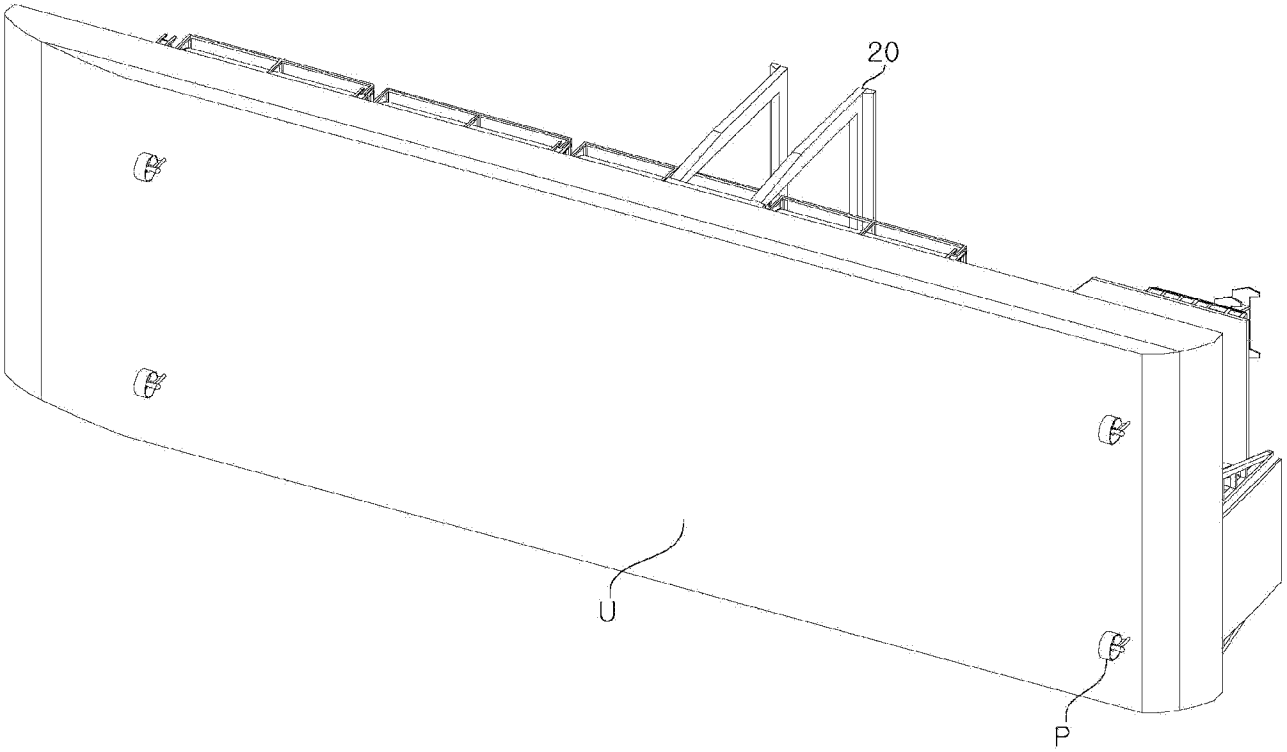
[FIG. 20]

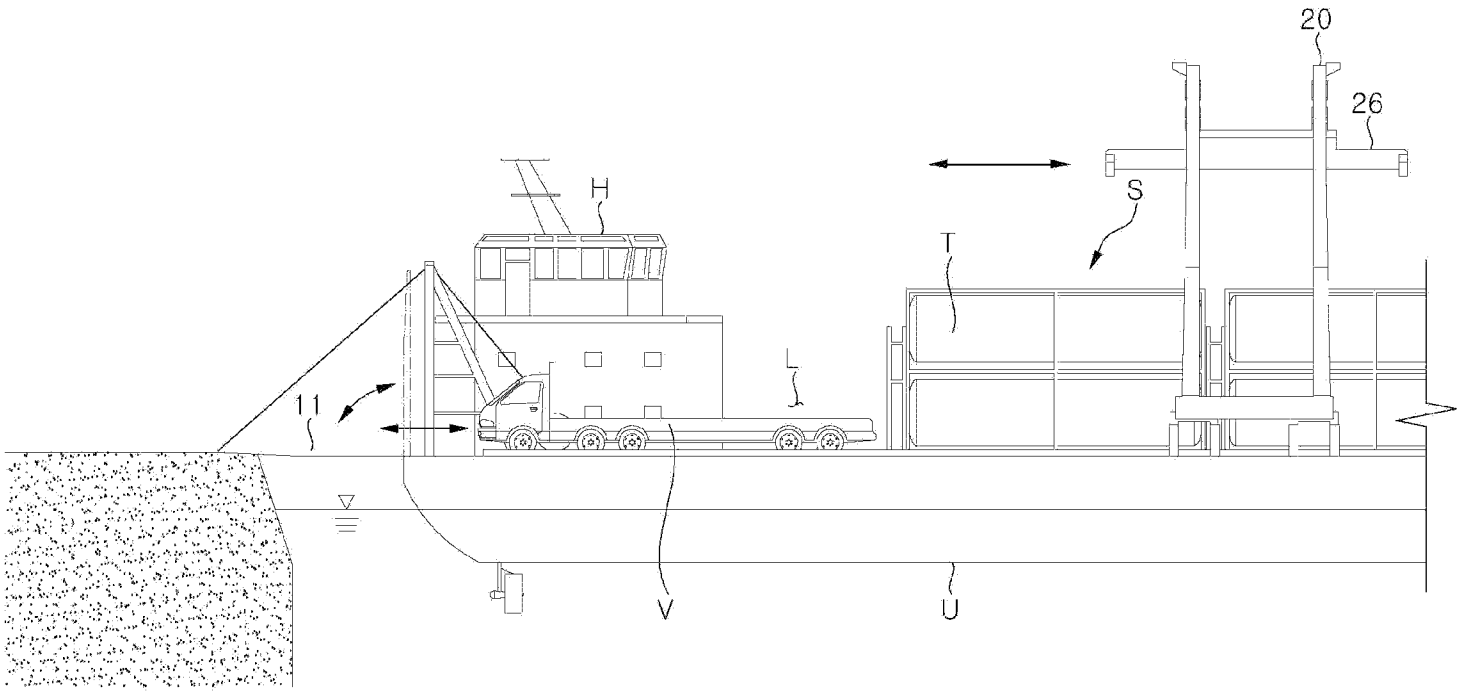
[FIG. 21]

【FIG. 22】
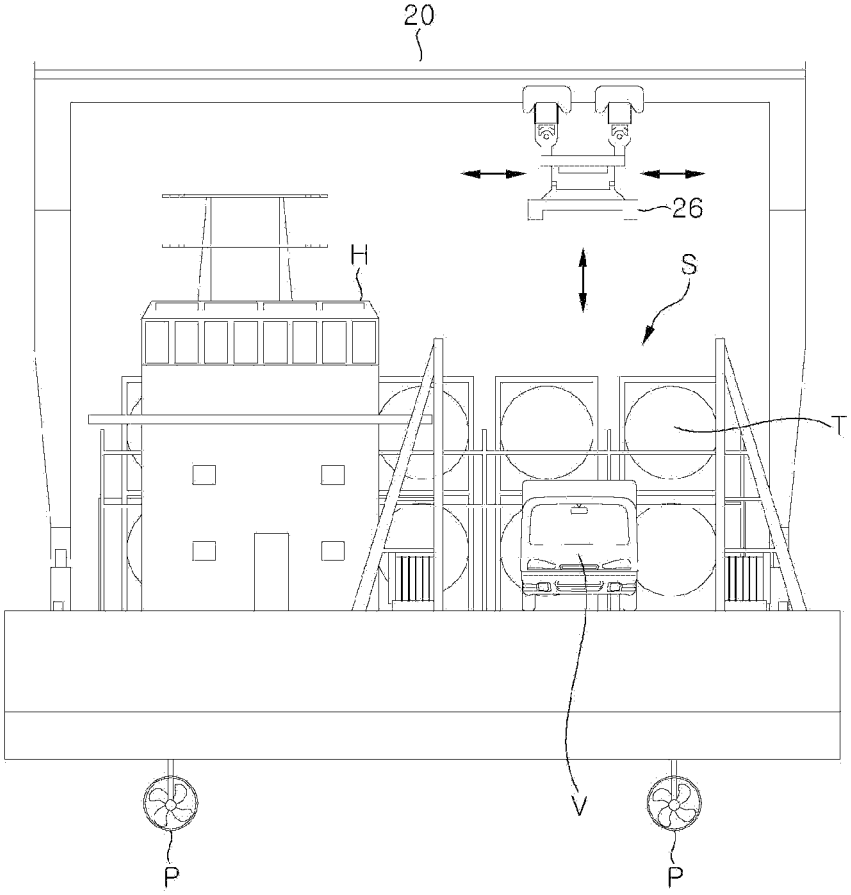

【FIG. 23】
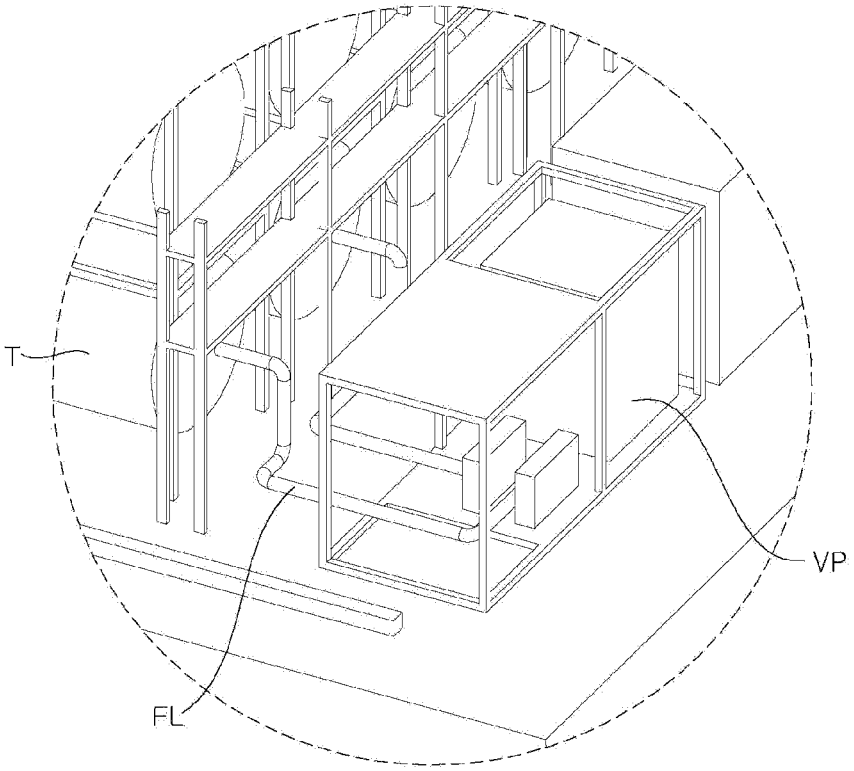

CONTAINER TRANSPORTATION SHIP

CROSS-REFERENCE TO RELATED APPLICATIONS

This application is a Continuation of U.S. application Ser. No. 16/329,627 filed Feb. 28, 2019, which is a U.S. National Stage of PCT/KR2017/009459 filed Aug. 30, 2017, which claims the priority benefit of Korean Patent Application No. 10-2016-0112020, filed on Aug. 31, 2016 and Korean Patent Application No. 10-2017-0096935, filed on Jul. 31, 2017 in the Korean Intellectual Property Office.

TECHNICAL FIELD

The present invention relates to a container transportation ship.

BACKGROUND ART

There are two general methods to supply natural gas to consumers. One is to supply natural gas directly to consumers through natural gas pipelines. The other is to supply liquefied natural gas (LNG) to consumers through tanker trucks. The latter is commonly used to supply natural gas to a remote place lacking a natural gas pipeline directly connected thereto.

However, this method has drawbacks in that it is necessary to install a separate stationary storage tank at a remote place and to periodically charge the stationary storage tank with LNG.

Demand for liquefied gas, especially LNG, is rapidly increasing worldwide. LNG is an eco-friendly fuel with little air pollutants emitted during combustion. Therefore, if LNG is used as a main fuel in various fields such as automobiles, ships and the like, it will be able to cope with environmental pollution problems such as carbon emissions and fine dusts.

In order to expand and generalize use of LNG as fuel, it is necessary to increase demand for LNG-fueled automobiles or to provide a small-scale LNG distribution facility to a remote place or insular region lacking gas supply infrastructure. As a way to supply LNG to an insular region lacking gas supply infrastructure, construction of new gas supply infrastructure in the insular region or transportation of LNG tank containers using LNG bunker shuttles may be considered.

Currently, there is no ship dedicated to carrying LNG tank containers. In addition, in order to ship such tank containers, a cargo handling facility including a harbor crane, a reach stacker and the like needs to be installed not only at a port where loading of the tank containers is conducted but also at a port where unloading of the tank containers is conducted. This results in a complicated transportation process, high costs, and deterioration in transportation reliability.

In addition, in order to construct new gas supply infrastructure such as a gas pipeline network, overcoming opposition from local residents is required. Further, since, in most cases, a target port and surroundings of the port are already occupied by other facilities, it is actually impossible to construct new gas supply infrastructure.

Also for loading/unloading of general containers, a port facility or requisite space for handling such containers is required. Therefore, there is a need for a dedicated ship capable of performing loading/unloading of containers at any port, regardless of position of such port facility and requisite space.

DISCLOSURE

Technical Problem

Embodiments of the present invention have been conceived to overcome such a problem in the art and it is one aspect of the present invention to provide a container transportation ship which is provided on the deck thereof with a cargo space in which containers are loaded and a loading/unloading space in which an external conveyance carrying the containers into/from the ship is stopped, and includes a crane moving the containers between the external conveyance and the cargo space to perform loading/unloading of the containers, whereby LNG can be economically and effectively supplied to an insular region using an existing port facility without the need to construct a separate container handling facility at a port.

Transportation of LNG tank containers using a general container ship has a problem in that it is impossible to supply LNG to a region lacking a port facility capable of loading/unloading the LNG tank containers. In addition, such a general container ship cannot sail in shallow waters such as inland rivers or coastal waters due to the special hull structure thereof and is economically infeasible due to high construction costs.

Therefore, it is another aspect of the present invention to provide a container transportation ship which allows a small-scale LNG distribution business using LNG tank containers, can transport LNG even to a source of demand lacking a related port facility, such as an insular region, can sail in shallow waters such as inland rivers or coastal waters, and can be constructed at considerably low costs.

Technical Solution

In accordance with one aspect of the present invention, there is provided a container transportation ship including: a cargo space in which one or more containers are loaded; a loading/unloading space which an external conveyance directly enters to load/unload the containers, the cargo space and the loading/unloading space being formed on a deck of the ship; and a crane moving the containers in longitudinal, transverse, and vertical directions of the ship to load/unload the containers onto/from the external conveyance having entered the loading/unloading space.

Preferably, the container transportation ship has a barge-type deck and underbody to form a flat hull and is provided on the underbody thereof with at least one propeller to propel the hull.

Preferably, at least one of the containers loaded in the cargo space is a tank container storing liquefied gas, wherein the container transportation ship further comprises: a power generation unit generating electricity to be supplied to the propeller; and a fuel supply line connected between the power generation unit and at least one of the tank containers in the cargo space to convey liquefied gas fuel from the at least one tank container to the power generation unit, the power generation unit and the fuel supply line being disposed on the deck.

Preferably, the fuel supply line is connected to at least one of the tank containers storing liquefied gas loaded in the cargo space and at least one of the tank containers connected to the fuel supply line belongs to a starboardmost or portmost column of tank containers and a sternmost row of tank containers.

Preferably, the fuel supply line is detachably connected to the tank container to be reconnected to another tank container when supply of liquefied gas from one tank container connected to the fuel supply line to the power generation unit is impossible.

Preferably, the container transportation ship further includes: a door unit opening/closing an entryway through which the external conveyance enters the ship; a guide unit guiding the external conveyance to the loading/unloading space; a positioning unit correcting a transverse position of the external conveyance; and a stop module restricting a position of the external conveyance in a moving direction of the external conveyance.

Preferably, the positioning unit further includes: a position sensing unit detecting the transverse position of the external conveyance; and a drive unit transversely moving the external conveyance based on the position of the external conveyance detected by the position sensing unit.

Preferably, the guide unit includes: a pressing unit forcing a pair of guide modules to transversely protrude; and a support step supporting the pressing unit, wherein the pressing unit is coupled at one end thereof to each of the guide modules and coupled at the other end thereof to the support step to adjust a transverse distance between the pair of guide modules facing each other.

Preferably, the container transportation ship further includes: guide rails formed at respective opposite sides of the ship parallel to the loading/unloading space to guide the crane to move in the longitudinal direction of the ship, wherein the guide rails are formed at an upper end of an outer wall of the ship or on the deck of the ship.

Preferably, the crane includes: a container holder formed corresponding to an upper surface of the container to hold the container; right and left columns coupled to guide rails formed at respective opposite ends of the ship, the right and left columns being movable on the guide rails; a bridge connected between upper ends of the right and left columns to be supported by the right and left columns, the bridge being movable along with the right and left columns; a horizontally movable part coupled to the bridge to move the container holder between the right and left columns; and a vertically movable part coupled to the horizontally movable part to vertically move the container holder.

In accordance with another aspect of the present invention, there is provided a container transportation ship which has a barge-type deck and underbody to form a flat hull, the container transportation ship comprising: at least one propeller formed on the underbody to propel the hull; a power generation unit formed at the stern on the deck to generate electricity to be supplied to the propeller; a cargo space disposed nearer to the bow on the deck than the power generation unit and allowing one or more tank containers storing liquefied gas to be loaded therein; and a loading/unloading space disposed nearer to the bow on the deck than the cargo space and allowing an external conveyance to enter to load/unload the tank containers; and a fuel supply line connected between the power generation unit and at least one of the tank containers to convey liquefied gas fuel from the at least one tank container to the power generation unit.

Preferably, the container transportation ship further includes: a pilot house disposed at the right or left of the loading/unloading space to steer the ship.

Preferably, the container transportation ship further includes: a reclosable door unit configured to be foldable such that the external conveyance enters the loading/unloading space from the outside of the ship through the reclosable door unit.

Preferably, the container transportation ship further includes: a crane moving the tank containers between the external conveyance having entered the loading/unloading space and the cargo space to perform loading/unloading of the tank containers.

Preferably, the power generation unit includes: a vaporizer regasifying liquefied gas supplied from the tank container through the fuel supply line; and a power generation module fueled by liquefied gas regasified by the vaporizer.

Preferably, the fuel supply line is connected to at least one of the tank containers loaded in the cargo space, wherein at least one of the tank containers connected to the fuel supply line belongs to a starboardmost or portmost column of tank containers and a sternmost row of tank containers.

Preferably, the fuel supply line is detachably connected to the tank container to be reconnected to another tank container when supply of liquefied gas from one tank container connected to the fuel supply line to the power generation unit is impossible.

Preferably, the power generation unit is encased.

Preferably, the power generation unit is isolated from the loading/unloading space by the cargo space.

In accordance with a further aspect of the present invention, there is provided a container transportation ship including: a cargo space in which a plurality of containers is loaded; a specific loading/unloading space which an external conveyance enters and stops to load/unload the containers, the cargo space and the loading/unloading space being formed on the deck of the ship; a passageway including a reclosable door unit opening/closing an entryway for the external conveyance, a guide unit including at least one pair of guide modules disposed at respective transverse ends of the loading/unloading space with respect to a moving direction of the external conveyance to guide the external conveyance to the loading/unloading space, a positioning unit including a plurality of roller bearings formed inside respective guide modules in transverse directions thereof, the plurality of roller bearings being transversely rotatable to correct a transverse position of the external conveyance, and a stop module disposed at one longitudinal end of the loading/unloading space to restrict a longitudinal position of the external conveyance; and a crane coupled to guide rails formed at respective opposite ends of the ship parallel to the loading/unloading space to be moved on the guide rails and including a container holder formed corresponding to an upper surface of the container to hold the container such that the container is moved in a vertical direction and in longitudinal and transverse directions of the guide rails by the crane.

Preferably, the positioning unit is configured to allow front and rear right and left drive wheels of the external conveyance to contact the respective roller bearings.

Preferably, the positioning unit further includes: a position sensing unit detecting a transverse position of the external conveyance through the roller bearings pressed by the wheels of the external conveyance; and a drive unit transversely driving the roller bearings to transversely move the external conveyance based on the position of the external conveyance detected by the position sensing unit.

Preferably, the guide unit further includes: a pressing unit coupled at one end thereof to each of the pair of guide modules and forcing the guide modules to transversely protrude to adjust a transverse distance between the pair of guide modules facing each other; and a support step coupled to the other end of the pressing unit to support the pressing unit.

Preferably, the stop module further includes: a reception groove receiving one of longitudinal drive wheels of the external conveyance; a reception sensing unit detecting that the reception groove receives the longitudinal drive wheel; and a confinement module confining the longitudinal drive wheel on the reception groove in response to a signal indicative of reception of the longitudinal drive wheel by the reception groove, the signal being transmitted from the reception sensing unit.

Preferably, the crane includes: right and left columns coupled to guide rails formed at respective opposite ends of the ship, the right and left columns being movable on the guide rails; a bridge connected between upper ends of the right and left columns to be supported by the right and left columns, the bridge being movable along with the right and left columns; a horizontally movable part coupled to the bridge to move the container holder between the right and left columns; and a vertically movable part coupled to the horizontally movable part to vertically move the container holder.

Preferably, the crane further includes a hydraulic cylinder coupled to the horizontally movable part and integrally driven with the vertically movable part to guide the container holder in a vertical direction.

Preferably, the guide rail is formed on respective opposite side surfaces thereof with a pair of auxiliary grooves recessed inwardly of the guide rail, and each of the right and left columns is formed at a lower end thereof with a main roller contacting an upper surface of the guide rail and a pair of auxiliary rollers inserted into the respective auxiliary grooves to be moved along the auxiliary grooves.

Preferably, the auxiliary groove is formed at an open outside thereof with a protruding step preventing separation of the auxiliary roller from the auxiliary groove.

Preferably, an outer circumferential surface of the main roller contacting the guide rail has a concave or convex curvature, and the upper surface of the guide rail has a convex or concave curvature corresponding to the curvature of the outer circumferential surface of the main roller.

Preferably, the crane is coupled to guide rails formed on the deck inside an outer wall of the ship and is movable in the longitudinal direction of the ship.

Preferably, the crane further includes a control room coupled to any one of the right and left columns to control the crane.

In accordance with yet another aspect of the present invention, there is provided a container transportation ship including: a cargo space in which a plurality of containers is loaded; a specific loading/unloading space which an external conveyance enters to load/unload the containers, the cargo space and the loading/unloading space being formed on the deck of the ship; a crane moving the containers in longitudinal, transverse, and vertical directions of the ship to load/unload the containers into/from the external conveyance having entered the loading/unloading space; and a passageway allowing entry of the external conveyance, wherein the crane is coupled to guide rails formed at respective opposite ends of the ship parallel to the loading/unloading space and includes an container holder formed corresponding to an upper surface of the container to hold the container, and the passageway includes: a reclosable door unit opening/closing an entryway for the external conveyance; a guide unit including at least one pair of guide modules disposed at respective transverse ends of the loading/unloading space with respect to a moving direction of the external conveyance to guide the external conveyance to the loading/unloading space; a positioning unit including a plurality of roller bearings formed inside the respective guide modules in transverse directions thereof, the plurality of roller bearings being transversely rotatable to correct a transverse position of the external conveyance; and a stop module disposed at one longitudinal end of the loading/unloading space to restrict a longitudinal position of the external conveyance.

The above and other aspects, features, and advantages of the present invention will become apparent from the detailed description of the following embodiments in conjunction with the accompanying drawings.

Unless otherwise defined herein, all terms including technical or scientific terms used herein have the same meanings as commonly understood by those skilled in the art to which the present invention pertains. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein.

Advantageous Effects

The present invention provides a container transportation ship which includes a cargo space allowing containers to be loaded therein and thus can be used as a dedicated container ship.

In addition, the container transportation ship according to the invention includes, in addition to the cargo space, a loading/unloading space which an external conveyance enters to transport containers to be loaded or unloaded into/from the ship and a crane moving the containers into/from the cargo space, such that an existing port facility can be utilized without a need to construct a separate container handling facility at a port, thereby reducing economic burden associated with delivery to an insular region or a remote place. Particularly, the container transportation ship can deliver LNG to a region lacking LNG supply infrastructure such as gas pipelines.

In addition, the container transportation ship can guide entry of the external conveyance into the loading/unloading space using a guide unit while adjusting a transverse position of the external conveyance using a positioning unit. Further, the container transportation ship can guide the external conveyance to be stopped in position in the loading/unloading space using a stop module. Accordingly, during container loading operations, a container holder of the crane can quickly hold a container on the external conveyance, and, during container unloading operations, a container can be stably placed at a predetermined location on the external conveyance.

In addition, the external conveyance can be locked in place in a transverse direction thereof by a pair of guide modules configured to press respective opposite sides of the external conveyance through adjustment of a transverse distance therebetween and can be locked in place in a moving direction thereof by a confinement module configured to confine drive wheels of the external conveyance, such that, even when the ship rocks, movement of the external conveyance relative to the ship can be prevented, thereby allowing quick and stable loading/unloading operations.

In addition, the container holder of the crane, configured to hold a container, can have the same in-plane behavior as the horizontally movable part by being vertically guided by a hydraulic cylinder coupled to a horizontally movable part and integrally driven with a vertically movable part, such that the position of the container holder relative to the ship can be maintained even when the ship rocks. Accordingly, quick and stable loading/unloading operations are possible.

In addition, right and left columns of the crane are each formed at a lower end thereof with auxiliary rollers inserted into auxiliary grooves formed on respective opposite side surfaces of the guide rail, such that a longitudinally moveable part of the crane can be moved in the longitudinal direction of the ship without being separated from the guide rails even when the ship pitches and rolls.

In addition, an additional control room is coupled to one side of the crane, such that the crane can be driven or controlled accurately and reliably, while control over operation of the crane can be appropriately corrected or supplemented.

In addition, the crane is coupled directly to guide rails on the deck, such that the present invention can be adapted to cope with various ship structures, while container loading/unloading operations can be stably performed in the specific loading/unloading space formed on the deck.

In addition, the container transportation ship according to the invention has a barge-type hull and thus can carry LNG tank containers through shallow waters while being constructed at reduced costs.

Therefore, the present invention is suitable for a small-scale LNG distribution business and thus can advantageously expand and generalize use of LNG as fuel, thereby providing a solution to environmental pollution such as carbon emissions and fine dust or global fuel and environmental problems such as introduction of sustainable eco-friendly fuels.

In addition, the container transportation ship according to the invention can deliver LNG even to diesel-fueled power plants operated in insular regions, such that power generation using LNG as fuel can be promoted, while providing efficient LNG distribution suitable for the scale of power generation on each island.

In addition, according to the present invention, the LNG tank container itself can be used as an LNG storage tank at a source of demand, such that a new LNG tank container transported by the container transportation ship can replace an empty LNG tank container, which, in turn, is returned to the ship, without a need to provide a separate stationary LNG tank to the source of demand, thereby reducing generation of boil-off gas (BOG), as compared with a conventional method in which a separate stationary LNG tank is used to store LNG supplied to the source of demand, while shortening the time required to supply LNG.

In addition, the container transportation ship according to the present invention is self-propelled using some LNG tank containers as a fuel tank and does not require a pump for fuel supply, thereby providing advantages in terms of space and energy efficiency.

In other words, it is possible to effectively arrange a variety of equipment within a limited space in the ship, thereby overcoming difficulty in securing space.

DESCRIPTION OF DRAWINGS

FIG. 1 is a perspective view of a container transportation ship according to a first embodiment of the present invention.

FIG. 2 is a partial plan view of the container transportation ship according to the first embodiment.

FIG. 3 is a partial schematic side view of the container transportation ship according to the first embodiment.

FIG. 4 is a partial plan view showing before adjustment by a positioning unit according to a first embodiment of the present invention.

FIG. 5 is a partial plan view showing after adjustment by the positioning unit according to the first embodiment.

FIG. 6 is a partial plan view of an exemplary modification of a guide unit according to a first embodiment of the present invention.

FIG. 7 is a partial sectional view showing before operation of a stop module according to a first embodiment of the present invention.

FIG. 8 is a partial sectional view showing after operation of the stop module according to the first embodiment.

FIG. 9 is a partial perspective view of a crane according to a first embodiment of the present invention.

FIG. 10 is a partial perspective view of the container transportation ship showing the crane according to the first embodiment.

FIG. 11 is a partial side view of the crane according to the first embodiment.

FIG. 12 is a perspective view showing coupling between right and left columns and a guide rail according to a first embodiment of the present invention.

FIG. 13 is a sectional view showing coupling between the right and left columns and the guide rail according to the first embodiment.

FIG. 14 is a sectional view showing an exemplary modification of the right and left columns and the guide rail according to the first embodiment.

FIG. 15 is a perspective view of a container transportation ship according to a second embodiment of the present invention.

FIG. 16 is a front view of the container transportation ship according to the second embodiment.

FIG. 17 is a rear view of the container transportation ship according to the second embodiment.

FIG. 18 and FIG. 19 are side views of the container transportation ship according to the second embodiment.

FIG. 20 is a bottom perspective view of the container transportation ship according to the second embodiment.

FIG. 21 is a partial side view illustrating a tank container loading/unloading method applied to the container transportation ship according to the second embodiment.

FIG. 22 is a partial front view illustrating the tank container loading/unloading method applied to the container transportation ship according to the second embodiment.

FIG. 23 is a partially enlarged view of a fuel supply line of the container transportation ship according to the second embodiment.

BEST MODE

The above and other aspects, features, and advantages of the present invention will become apparent from the detailed description of the following embodiments in conjunction with the accompanying drawings. It should be noted that like components will be denoted by like reference numerals throughout the specification.

It will be understood that, although the terms "one surface", "the other surface", "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. In addition, the terms "longitudinal direction", "transverse direction", and "vertical direction", as used herein for convenience of description, correspond to the X, Y, Z axes in FIG. 1, respectively.

Further, the term "container transportation ship" may also be briefly referred to as "transportation ship" or "ship".

Moreover, description of known functions and constructions which may unnecessarily obscure the subject matter of the present invention will be omitted.

Hereinafter, exemplary embodiments of the present invention will be described in detail with reference to the accompanying drawings.

First, a container transportation ship according to a first embodiment of the present invention will be described with reference to FIG. 1 to FIG. 14.

As described in the first embodiment, the term "container" T is defined as including LNG tank containers T according to International Organization for Standardization (ISO) standards and a variety of other types of containers T.

FIG. 1 is a perspective view of a container transportation ship according to the first embodiment, FIG. 2 is a partial plan view of the container transportation ship according to the first embodiment, and FIG. 3 is a partial schematic side view of the container transportation ship according to the first embodiment.

The container transportation ship according to the first embodiment includes: a cargo space S in which a plurality of containers T is loaded and a specific loading/unloading space L which an external conveyance V enters to load/unload the containers T, wherein the cargo space and the loading/unloading space are formed on a deck of the ship.

In addition, the container transportation ship further includes: a reclosable door unit 11 opening/closing an entryway for the external conveyance V; a guide unit 12 including at least one pair of guide modules 12*a* disposed at respective transverse opposite ends of the loading/unloading space with respect to a moving direction of the external conveyance V to guide the external conveyance V into the loading/unloading space L; a positioning unit 13 including a plurality of roller bearings 13*a* formed inside the respective guide modules 12*a* in transverse directions thereof and transversely rotatable to correct a transverse position of the external conveyance V.

In addition, the container transportation ship further includes: a passageway 10 including a stop module 14 disposed at one longitudinal end of the loading/unloading space L to restrict a position of the external conveyance V in the moving direction thereof; and a crane 20 coupled to guide rails formed at respective opposite ends of the ship parallel to the loading/unloading space L to be moved on the guide rails to load/unload the container T into/from the external conveyance V having entered the loading/unloading space L, wherein the crane includes an container holder 26 formed corresponding to an upper surface of the container T so as to move the container T in longitudinal and transverse directions of the guide rails 31 and in a vertical direction.

Referring to FIG. 1 and FIG. 2, in the container transportation ship according to the first embodiment, the cargo space S in which the containers T are loaded and the specific loading/unloading space L in which the external conveyance V is stopped are formed on the deck.

In the cargo space S, the plurality of containers T may be three-dimensionally loaded in the longitudinal, transverse, and vertical directions of the ship, as shown in FIG. 1.

In addition, the cargo space S may be provided therein with lashing bridges 32*s* arranged at regular longitudinal intervals corresponding to the length of the container T, wherein each of the lashing bridges 32*s* corresponds to the width of the ship. Accordingly, the plurality of containers T can be stably loaded by coupling each of the containers T to a corresponding one of the lashing bridges 32 using a predetermined fastener (not shown).

Further, the containers T may be standardized, and the cargo space S may be modularized such that the containers T can be loaded at predetermined locations.

As shown in FIG. 2 and FIG. 3, the loading/unloading space L is a space which the external conveyance V enters to carry a container T loaded in the cargo space S from the ship or to carry a container T to be loaded into the cargo space S into the ship. Here, the external conveyance V refers to a means for carrying a container T, such as a tractor, and may include unmanned vehicles.

Preferably, the loading/unloading space L is formed at an end of the cargo space S in an opening/closing direction of the reclosable rod 11 described below. In this way, the external conveyance V can enter the loading/unloading space L through a reclosable door along a shortened route, while the cargo space S can be efficiently utilized without wasted space.

Although the container transportation ship is shown as including one loading/unloading space L in FIG. 2 and FIG. 3, it should be understood that the present invention is not limited thereto and the container transportation ship may include a plurality of loading/unloading spaces L depending on the size of the ship and work efficiency. For convenience of explanation, the container transportation ship will be described as including one loading/unloading space L herein.

The external conveyance V needs to be stopped in position in the loading/unloading space L. This is also associated with work efficiency in that the container holder 26 of the crane 20, described below, can be quickly coupled to a container T on the external conveyance V during container loading operations. In addition, during container unloading operations, if the external conveyance V is stopped out of position, not only can a container T not be loaded quickly onto the external conveyance V, but also the container T can be dislocated with respect to the external conveyance V, causing a serious accident such as falling of the container T.

In order to improve work efficiency and safety, it is necessary to stop the external conveyance V in position in the loading/unloading space L, which can be accomplished by the passageway 10 including the reclosable door unit 11, the guide unit 12, the positioning unit 13, and the stop module 14.

The reclosable door unit 11 opens/closes an entryway through which the external conveyance V enters the loading/unloading space L. When the transportation ship is anchored in a port, as shown in FIG. 2 and FIG. 3, the reclosable door unit 11 connects the deck of the transportation ship to the port, such that the external conveyance V can enter the loading/unloading space L. When loading/unloading operations are completed and the transportation ship leaves the port, as shown in FIG. 1, the reclosable door unit 11 is pivoted to close the entryway.

Although the reclosable door unit 11 is preferably formed at the stern of the ship to facilitate entry of the external conveyance V when the transportation ship is anchored in a small port in an insular region, it should be understood that the present invention is not limited thereto and the reclosable door unit 11 may be formed at a side of the ship.

As shown in FIG. 2, the guide unit 12 includes at least one pair of guide modules 12*a* disposed at respective transverse opposite ends of the loading/unloading space with respect to the moving direction of the external conveyance V entering through the reclosable door unit 11. In this way, the transverse position of the external conveyance V can be guided by the pair of guide modules 12*a*, such that the external conveyance V can enter the loading/unloading space L having a specified width. Preferably, a distance between the pair of guide modules 12*a*, that is, the width thereof, corresponds to or is slightly greater than the width of the external conveyance V.

Although the transverse position of the external conveyance V is primarily restricted through guidance of the guide unit 12, a transverse center of the external conveyance V cannot coincide exactly with a transverse center of the loading/unloading space L due to pitching and rolling of the ship or difficulty in driving the external conveyance V, which is large in size.

Accordingly, the transverse position of the external conveyance V is secondarily corrected through transverse rotation of the plurality of roller bearings 13*a* of the positioning unit 13, wherein the roller bearings 13*a* are formed inside the respective guide modules 12*a* in the transverse directions thereof to be transversely rotated, as shown in FIG. 2. In this way, through position correction by the positioning unit 13, the transverse center of the external conveyance V can coincide exactly with the transverse center of the loading/unloading space L.

As shown in FIG. 3, the positioning unit 13 may be configured such that front and rear right and left drive wheels R of the external conveyance V contact the respective roller bearings 13*a*, and may be formed to cover the entire contact surface of each of the drive wheels R. Thus, the positioning unit 13 may consist of separate parts continuously formed to cover the entire contact surfaces of the respective front and rear right and left drive wheels R. Details of operation of the positioning unit 13 will be described further below.

The stop module 14 is configured to guide a position at which the external conveyance V is to be stopped in the moving direction thereof and is disposed at one longitudinal end of the loading/unloading space L to restrict a position of the external conveyance V in the moving direction thereof. That is, the external conveyance V can no longer move upon reaching the stop module 14, such that a longitudinal position of the external conveyance V, that is, a position of the external conveyance in the moving direction thereof, can be restricted, while allowing the external conveyance V to be stopped at a specified location in the longitudinal direction of the loading/unloading space L.

The stop module 14 may protrude from the deck to restrict movement of the drive wheels R of the external conveyance V and may be formed continuously or discontinuously corresponding to the transverse direction of the external conveyance V.

Once the external conveyance V is placed in position in the specific loading/unloading space L by the components of the passageway 10, using the crane 20, a loading or unloading operation is performed to move a container T into the cargo space S from the external conveyance V or to move a container T onto the external conveyance V from the cargo space S.

The crane 20 is coupled to the guide rails 31 formed at respective ends of the ship parallel to the loading/unloading space L and is moved as a whole along the guide rails 31 in the longitudinal direction of the ship. Here, for maximum utilization of the deck of the ship as the cargo space S, the guide rails 31 may be formed at an upper end of an outer wall W of the ship, as shown in FIG. 1 and FIG. 2. Alternatively, the guide rails 31 may be formed directly on the deck D of the ship depending on the structure of the ship.

In addition, the movement of the crane 20 along the guide rails 31 may be achieved by driving a main roller 21*a* formed at a lower end of the crane 20 to contact each of the guide rails 31.

In order to move the container T, the crane 20 includes the container holder 26 formed corresponding to the upper surface of the container T and attaching the container to the crane. Thus, the crane can move the container T in a vertical direction, in a longitudinal direction of the guide rails 31, and in a transverse direction perpendicular to the longitudinal direction. In this way, with the crane 20 formed in the ship, loading or unloading of the containers T into the cargo space S can be achieved and the containers T to be loaded or unloaded can be transported into or from the ship by the external conveyance V stopped in the loading/unloading space L.

As a result, loading/unloading of the containers T can be achieved using an existing port facility without construction of a separate container-handling port facility, thereby reducing economic burden associated with delivery to insular regions.

Therefore, the first embodiment of the present invention provides a dedicated container transportation ship that includes a cargo space S in which containers T are loaded.

Next, the guide unit 12, the positioning unit 13, and the stop module 14 of the passageway 10 will be described in detail with reference to FIG. 4 to FIG. 8, and repeated description will be omitted for clarity.

FIG. 4 and FIG. 5 are partial plan views illustrating before and after adjustment by the positioning unit 13 according to a first embodiment of the present invention, respectively, with reference to which a first embodiment of a principle for correcting the transverse position of the external conveyance V will be described.

In this embodiment, the positioning unit 13 includes a position sensing unit 13*b* and a drive unit 13*c*. Referring to FIG. 4, when the drive wheel R of the external conveyance V contacts the roller bearing 13*a*, the position sensing unit 13*b* senses the transverse position of the external conveyance V through the roller bearing 13*a* pressed by the drive wheel. The position sensing unit 13*b* is disposed under the roller bearing 13*a* to sense the transverse position of the external conveyance V by detecting a region thereof which is pressed by the roller bearing.

The transverse position of the external conveyance V sensed by the position sensing unit 13*b* is transmitted to the drive unit 13*c*, which, in turn, transversely drives the roller bearing 13*a* based on the sensed transverse position of the external conveyance. As the roller bearing 13*a* is transversely driven, the drive wheel R of the external conveyance V on the roller bearing 13*a* is transversely moved, such that the external conveyance V can be transversely moved, as shown in FIG. 5.

When the positioning unit 13 is discontinuously formed as shown in the drawings, the roller bearings 13*a* of respective separate parts of the positioning unit 13 may be individually driven by the respective drive units 13*c*, such that, even when the external conveyance V is tilted with respect to a transverse center axis, the transverse position of the external conveyance V can be corrected such that the external conveyance V coincides with the transverse center axis.

FIG. 6 is a partial plan view of an exemplary modification of the guide unit 12 according to a first embodiment of the present invention, with reference to which an exemplary modification of the principle for correcting the transverse position of the external conveyance V will be described.

In this embodiment, the guide unit 12 further includes, in addition to the at least one pair of guide modules 12*a*, a pressing unit 12*b* and a support step 12*c* to correct the transverse position of the external conveyance V by adjusting a transverse distance between the pair of guide modules 12*a* facing each other.

One end of the pressing unit 12*b* is coupled to an outer surface of each of the pair of guide modules 12*a* to force the pair of guide modules 12*a* to protrude inward in the transverse direction. In addition, the other end of the pressing unit 12*b* is coupled to the support step 12*c* to be supported by the support step 12*c*.

In this way, the transverse distance between the pair of guide modules 12*a* can be adjusted, such that the transverse position of the external conveyance V with the drive wheels R contacting the respective roller bearings 13*a* can be corrected. Further, according to this embodiment, not only can the transverse position of the external conveyance V be corrected, but also the external conveyance V can be locked in place in the transverse direction by being pressed at both sides thereof by the guide modules 12*a*.

Moreover, the guide unit 12 may further include an additional roller bearing (not shown) coupled to a contact surface thereof with a side surface of the drive wheel of the external conveyance V to allow the external conveyance V transversely locked in place by the guide unit 12 to move toward the stop module 14 and configured to rotate in a direction of the stop module 14 to minimize friction on the contact surface, such that the external conveyance transversely locked in place by the guide unit 12 can be reversed to rest on the stop module 14 described below.

FIG. 7 and FIG. 8 are partial sectional views illustrating before and after operation of the stop module 14 according to a first embodiment of the present invention, with reference to which the stop module 14 configured to lock the moving direction of the external conveyance V according to the first embodiment will be described.

In this embodiment, the stop module 14 further includes a reception groove 14*a*, a reception sensing unit (not shown), and a confinement module 14*b* to lock the moving direction of the external conveyance V, that is, the longitudinal direction of the external conveyance.

In this embodiment, the reception groove 14*a* is recessed inwardly of the stop module 14 in the moving direction of the external conveyance V to receive any one of longitudinal drive wheels R of the external conveyance V. Reception of the longitudinal drive wheel R by the reception groove 14*a* is detected by the reception sensing unit.

Although not shown in the drawings, the reception sensing unit may be provided in the form of a button that is formed inside the reception groove to detect the presence of the drive wheel R in the reception groove through contact with the drive wheel R. However, it should be understood that the present invention is not limited thereto and the reception sensing unit may be provided in any other suitable form known in the art.

Upon sensing reception of the drive wheel R by the reception groove 14*a*, the reception sensing unit transmits a signal indicative thereof to the confinement module 14*b*, which, in turn, confines the drive wheel R on the reception groove 14*a* in response to the signal.

The confinement module 14*b* is formed at an open outside of the reception groove 14*a* and may be configured to protrude transversely inwardly of the reception groove 14*a* and to be coupled to the drive wheel R to confine the drive wheel R upon receiving the signal. However, it should be understood that the present invention is not limited thereto and the confinement module 14*b* may be implemented in various other ways.

As described above, the external conveyance V can be placed in position in the specific loading/unloading space L by the positioning unit 13 or the guide unit 12, such that quick and reliable loading/unloading operations can be achieved.

In addition, the transverse and longitudinal positions of the external conveyance V can be locked by the guide unit 12 and the stop module 14, such that, even when the ship pitches and rolls, the external conveyance V is not moved relative to the ship, thereby allowing smooth loading/unloading operations. Further, since the external conveyance V can be held in place in the ship, the ship can sail at sea with the external conveyance V loaded thereon, such that the external conveyance V carrying the containers T to/from the ship can also be supplied to insular regions, along with the containers T.

Next, the crane 20 used in the first embodiment of the present invention will be described in detail with reference to FIG. 9, FIG. 10, and FIG. 11, and repeated description will be omitted for clarity.

FIG. 9 is a partial perspective view of the crane 20 according to a first embodiment of the present invention, FIG. 10 is a partial perspective view illustrating a control room formed at one side of the crane according to the first embodiment, and FIG. 11 is a side view of the crane.

Referring to FIG. 9, the crane 20 according to the first embodiment includes right and left columns 21, a bridge 22, a horizontally movable part 23, a vertically movable part 24, and a hydraulic cylinder 25.

In this embodiment, the right and left columns 21 are coupled to the guide rails 31 formed at respective opposite ends of the ship and are moved in the longitudinal direction of the guide rails 31 through operation of the main roller 21*a* contacting the upper surface of each of the guide rails 31.

In this embodiment, the bridge 22 is connected between upper ends of the right and left columns 21 to be supported by the right and left columns 21 and is moved in the longitudinal direction of the guide rails 31 along with the right and left columns 21.

Since the right and left columns 21 and the bridge 22 are moved as a whole in the longitudinal direction of the guide rails 31, the number of required members, such as the number of columns, can be reduced, as compared with when the bridge 22 is moved alone. In addition, since the bridge 22 is directly supported by the right and left columns 21, damage to the members, such as buckling, can be prevented.

Although the crane includes one pair of right and left columns 21 and one bridge 22, in order to stably support the container holder 26, the crane may include a first pair of right and left columns 21', a second pair of right and left columns 21" spaced apart from the first pair of right and left columns 21' in the longitudinal direction of the guide rails 31, and a pair of bridges, that is, a first bridge 22' connected between the first pair of right and left columns 21' and a second bridge 22" connected between the second pair of right and left columns 21".

Referring to FIG. 10, the crane may further include a control room CR formed on any one of the right and left columns 21 to individually control the crane. The control room CR may be manned to directly control and operate the crane or may be equipped with an individual automatic control device.

In this embodiment, the horizontally movable part 23 is coupled to the bridge 22 to be driven along the bridge 22 in a transverse direction of the right and left columns 21 to move the container holder 26 between the right and left columns 21, that is, in the transverse direction of the right and left columns 21. The crane may include a single or plurality of horizontally movable parts 23. When the crane includes a plurality of horizontally movable parts 23, the horizontally movable parts 23 may be connected to one another through a plate 23*a* to be moved integrally.

In this embodiment, the vertically movable part 24 is coupled to the horizontally movable part 23 to move the container holder 26 up and down with respect to the bridge 22 to which the horizontally movable part 23 is coupled.

Referring to FIG. 11, the hydraulic cylinder 25 is coupled at one end thereof to the bridge 22 to be physically secured thereto and is coupled at the other end thereof to the container holder 26 holding the container T. Accordingly, when the container holder 26 holding the container T is driven up and down to load/unload the container T onto/from the external conveyance V, the hydraulic cylinder can minimize swinging of the container T, thereby minimizing the risk of damage to the container T due to lateral movement during load/unloading operations while securing loading/unloading reliability.

That is, the hydraulic cylinder 25 is coupled at ends thereof to the horizontally movable part 23 and the container holder 26, respectively, and is driven integrally with the vertically movable part 24 to guide vertical movement of the container holder 26. Accordingly, rocking of the ship can be transferred to the container holder 26 through the horizontally movable part 23, such that the container holder 26 can be easily coupled to the container T without wobbling relative to the ship even when the ship rocks.

In addition, the hydraulic cylinder 25 may be coupled to the horizontally movable part 23 through the plate 23*a* and the crane may include a single or plurality of hydraulic cylinders. When the crane includes a plurality of hydraulic cylinders, each of the plurality of hydraulic cylinders may be coupled to a corresponding one of four corners of the plate 23*a*.

FIG. 12 and FIG. 13 are a perspective view and sectional view illustrating coupling between the right and left columns 21 and the guide rail 31 according to a first embodiment of the present invention and FIG. 14 is a sectional view of a modification of the right and left columns 21 and the guide rail 31 according to the first embodiment, with reference to which coupling between the right and left columns 21 and the guide rail 31 will now be described in detail.

Referring to FIG. 12, movement of the right and left columns 21 is achieved by the main roller 21*a* adjoining the upper surface of the guide rail 31. The main roller 21*a* is formed on the ship and thus is at risk of being separated from the guide rail 31 due to rolling and pitching of the ship.

In order to prevent separation of the main roller 21*a*, the guide rail 31 is formed at respective opposite sides thereof with auxiliary grooves 31*a* recessed inwardly of the guide rail, and each of the right and left columns 21 is formed at a lower end thereof with a pair of auxiliary rollers 21*b* configured to be inserted into and moved along the respective auxiliary grooves 31*a*.

Since the pair of auxiliary rollers 21*b* is inserted into the respective auxiliary grooves 31*a*, even when the ship rolls and pitches, the right and left columns 21 can be prevented from wobbling by being supported by the auxiliary rollers 21*b*, thereby preventing separation of the main roller 21*a* formed at the lower end of each of the right and left columns 21.

Further, the auxiliary groove 31*a* of the guide rail 31 may be formed at an open outside thereof with a protruding step 31*b* preventing separation of the auxiliary roller 21*b*, such that the right and left columns 21 can be more firmly coupled to the guide rail 31.

Moreover, a contact surface between the main roller 21*a* and the guide rail 31 may be formed uneven rather than flat to restrict the moving direction of the main roller 21*a*, thereby further preventing separation of the main roller 21*a*.

That is, an outer circumferential surface of the main roller 21*a* adjoining the guide rail 31 may have a concave or convex curvature, while the upper surface of the guide rail 31 may have a convex or concave curvature corresponding to the curvature of the outer circumferential surface of the main roller 21*a*, as shown in FIG. 14.

Next, a container transportation ship according to a second embodiment of the present invention will be described with reference to FIG. 15 to FIG. 23.

In accordance with a second embodiment of the present invention, there is provided a container transportation ship which can transport liquefied gas tank containers to a source of demand lacking infrastructure for supply of liquefied gas, such as an insular region, while being capable of sailing in shallow waters such as inland rivers or coastal waters.

A container transportation ship according to the second embodiment is a modification of the container transportation ship according to the first embodiment set forth above and differs from the container transportation ship according to the first embodiment in that the container transportation ship according to the second embodiment has a barge-type hull, is adapted to carry LNG tank containers, and is fueled by LNG. The other components of the container transportation ship according to the second embodiment, excluding the differences mentioned above, may have the same shape or function as those in the first embodiment and thus will be denoted by the same reference numerals and the same names as those in the first embodiment, and detailed description thereof will be omitted. It should be understood that description given in the first embodiment can also be applied to the second embodiment, despite being omitted.

As used herein, the term "container" is defined as including LNG tank containers T according to ISO standards and various other types of containers. In addition, although the present invention will be described using an LNG tank container as an example in the following embodiments, the present invention may also be applied to a variety of other liquefied gases. It should be understood that the following embodiments are not intended to limit the scope of the invention and may be embodied in a variety of other forms.

Referring to FIG. 15 to FIG. 23, the container transportation ship according to the second embodiment has a barge-type hull. That is, a deck D and underbody U of the hull are flat and large in area.

In this embodiment, the container transportation ship is provided on the underbody U with at least one propeller P driven by a motor and generating thrust for propulsion of the hull. Preferably, the container transportation ship is provided with a total of four propellers, one for each of the starboard bow and stern and the port bow and stern, as shown in FIG. 20. However, it should be understood that the number and location of propellers are not limited thereto.

Referring to FIG. 15, the container transportation ship according to this embodiment is provided on the deck D with a cargo space S in which one or more containers T are loaded, a loading/unloading space L in which an external conveyance V is disposed to load/unload the containers T, a pilot house H controlling the ship, and a power generation unit G generating electric power to be supplied to the propeller P.

Although the container T loaded in the cargo space S may include LNG tank containers T and containers storing other types of cargoes, hereinafter, the term "container" T or "tank container" T will be defined to refer to an LNG tank container T and the cargo space S will be described as loaded with such LNG tank containers T.

In this embodiment, the power generation unit G is disposed on the deck D at the stern and the loading/unloading space L and the pilot house H are disposed on the deck at the bow. In addition, the cargo space S may be disposed between the power generation unit G disposed at the stern and the loading/unloading space L and pilot house H disposed at the bow. Accordingly, the cargo space S isolates the power generation unit G at the stern from the loading/unloading space L and pilot house H at the bow.

Although the loading/unloading space L and the pilot house H at the bow may be disposed at the port and starboard sides or at the starboard and port sides, respectively, the loading/unloading space L and the pilot house H are shown as disposed at the port and starboard sides, respectively, in FIG. 15.

If the pilot house H is disposed at the stern, there is difficulty in securing visibility for controlling the ship due to the containers T in the cargo space S or a crane 20 described below, while a height to which the containers T are stacked in the cargo space S can be limited. According to this embodiment, since the pilot house H is disposed at the bow, it is easy to secure visibility, while the height to which the containers T are stacked in the cargo space S is less limited.

In addition, since the pilot house H is disposed at the stern and the power generation unit G is disposed at the bow such that the cargo space S isolates the pilot house H from the power generation unit G, it is possible to prevent noise or vaporized substances from the power generation unit G from having an influence on the pilot house H.

Further, since the loading/unloading space L is disposed at the bow along with the pilot house H, the cargo space S can be enlarged while the external conveyance V can easily enter the cargo space S along a shortened route from the outside of the ship (for example, from the land). Moreover, since the pilot house H is disposed at the same side as the loading/unloading space L, it is easy to bring the ship alongside a berth in the port.

Although the container transportation ship according to this embodiment is shown as including one loading/unloading space L in FIG. 15, it should be understood that the present invention is not limited thereto and the container transportation ship may include a plurality of loading/unloading spaces depending on the size of the ship or work efficiency.

In this embodiment, the cargo space S allows the containers T to be loaded therein, is disposed between the bow at which the pilot house H and the loading/unloading space L are disposed and the stern at which the power generation unit G is disposed, and occupies most of the area of the deck D, as shown in FIGS. 15 and 19.

The cargo space S is configured such that the containers T can be three-dimensionally loaded therein along longitudinal, transverse, and vertical directions of the ship. In addition, the cargo space S may be modularized such that a large number of containers T can be arranged in regular rows and columns in the cargo space S and can be safely secured even when the ship rolls and pitches.

For example, the cargo space may be provided with a row frame (not shown) and/or a column frame (not shown) to form a matrix structure consisting of multiple cells each allowing the container T to be safely loaded therein.

In this embodiment, the row frame and the column frame may be a lashing bridge as described in the first embodiment and detailed description thereof will be omitted herein.

FIG. 18 is a side view of the ship with the containers T removed from the cargo space S. Referring to FIG. 18, five row frames are disposed to divide the cargo space S into four rows.

FIG. 19 is a side view of the ship of FIG. 18 in which the cells of the cargo space S, formed by five row frames, are all loaded with the containers T. Referring to FIG. 19, the containers T are loaded in two columns inside each cell. However, it should be understood that the present invention is not limited thereto and the number of containers T and the number and shape of row and column frames may be varied depending on the size of the ship.

As shown in FIG. 15 to FIG. 22, the container transportation ship according to this embodiment further includes a crane 20 formed on the deck D thereof and adapted to hold the containers T and to move the containers T in the longitudinal, transverse, and vertical directions of the ship.

As shown in FIG. 15, the crane 20 may include a container holder 26, which is movable in the longitudinal and transverse directions of the ship along longitudinal guide rails 31 formed at respective starboard and port sides on the deck D and a transverse guide rail (not denoted by reference numeral), respectively, is movable up and down, and is configured to hold the containers T.

In this embodiment, the crane 20 may be a gantry crane. Alternatively, the crane 20 may be the same as the crane described in the first embodiment and detailed description thereof will be omitted.

Next, operation of the crane 20 according to the second embodiment of the invention will be briefly described with reference to FIG. 21 and FIG. 22. When the external conveyance V enters the loading/unloading space L, the crane 20 is moved to a row of containers to which a container T to be loaded onto the external conveyance V belongs along the longitudinal guide rails 31 and the container holder 26 is then moved to a column of containers to which the container T belongs along the transverse guide rail. Then, the container holder 26 is moved down to hold the container T. Then, the container holder 26 holding the container T is moved along the transverse rail and the longitudinal rails 31 to move the container T to the loading/unloading space L and then places the container T on the external conveyance V disposed in the loading/unloading space L.

When the external conveyance V carrying a container T enters the loading/unloading space L, the crane 20 is moved to the loading/unloading space L and the container holder 26 holds the container T on the external conveyance V. Then, the container holder 26 is moved to a specific location in the cargo space S at which the container T is to be loaded and places the container T at the specific location.

Here, the container T loaded onto the external conveyance V from the cargo space S and the container T loaded into the cargo space S from the external conveyance V may be a container T storing LNG to be supplied to a source of demand or an empty container T that is returned from a source of demand after exhaustion of LNG therein.

In addition, the container transportation ship according to this embodiment further includes a reclosable door unit 11 configured to be foldable to allow entry/exit of the external conveyance V therethrough. The reclosable door unit 11 is pivotably disposed at an end of the loading/unloading space L of the ship, that is, at the bow, and is configured to be folded or unfolded by being pivoted.

When the ship is anchored in a port, as shown in FIG. 21, the reclosable door unit 11 is opened to connect the ship to the port to allow entry/exit of the external conveyance V, and, when the ship sails at sea, the reclosable door unit 11 remains folded, as shown in FIG. 16.

When the reclosable door unit 11 is connected between the ship and the port, the external conveyance V can enter the loading/unloading space L in the ship along the reclosable door unit 11. Here, the external conveyance V entering the loading/unloading space L may carry a container T filled with LNG or an empty container T or may not carry any container T. When the external conveyance V carrying a container T enters the loading/unloading space L, the crane may load another container T onto the external conveyance V from the cargo space S after moving the previous container T from the external conveyance V to the cargo space S.

A container T filled with LNG may be delivered to a source of demand such as a remote place by door unit in the external conveyance V. Here, the source of demand may include an LNG fueling station supplying LNG to a vehicle powered by LNG, an LNG satellite base installed in a peripheral region, and a power plant powered by LNG. A container T transported by the external conveyance V may be unloaded at the source of demand to be used as a reservoir and an empty container T, LNG of which is exhausted, may be returned to the container transportation ship by the external conveyance.

In this embodiment, the power generation unit G serves to generate electric power to be supplied to the propeller P, such that the propeller P is driven by electric power to allow the container transportation ship to be self-propelled.

The power generation unit G may produce electric power using LNG in an LNG tank container T loaded in the cargo space S as fuel, wherein the container transportation ship may further include a fuel supply line FL connected between the power generation unit G and at least one of a plurality of LNG tank containers T loaded in the cargo space S, as shown in FIG. 23. That is, LNG in the container T is supplied as fuel to the power generation unit G through the fuel supply line FL.

The fuel supply line FL may be provided in the form of a double pipe that consists of an inner pipe through which LNG flows and an outer pipe encasing the inner pipe to prevent leakage of LNG supplied from the tank container T to the power generation unit G.

The power generation unit G may further include a vaporizer VP regasifying LNG supplied through the fuel supply line FL and a power generation module generating electricity using LNG regasified by the vaporizer VP as fuel.

The power generation module may be composed of a power generation engine driven through combustion of natural gas and a generator converting driving power of the power generation engine into electrical energy. Alternatively, the power generation module may be composed of a gas turbine driven by natural gas and a generator converting torque of the gas turbine into electric energy or may be a fuel cell. In this embodiment, the power generation module will be described as composed of the power generation engine and the generator. However, it should be understood that the present invention is not limited thereto.

In this embodiment, the vaporizer VP may be a fin-type heat exchanger that uses the atmosphere as a heat source, such that the size of the power generation unit G and thus footprint of the power generation unit G on the deck D can be reduced, thereby improving space efficiency.

As described above, the power generation unit G is disposed on the deck D at the stern, and, in the drawings, the vaporizer VP and the power module are shown as disposed at the starboard and port sides, respectively.

The fuel supply line FL may connect the power generation unit G to any one or two or more, preferably two of sternmost tank containers T in the cargo space S. More preferably, the fuel supply line FL connects the power generation unit G to a starboardmost tank container T among the strenmost tank containers T.

In addition, the fuel supply line FL may have a detachable connection to the tank container T such that, when LNG in a tank container T connected to the fuel supply line is exhausted during operation of the ship, another tank container in the cargo space S can be easily connected to the power generation unit G through the fuel supply line FL to supply LNG to the power generation unit G.

Specifically, the fuel supply line FL may be reconnected to a tank container belonging to a column of tank containers next to a previous tank container, LNG of which is exhausted, or to a row of tank containers immediately above or below the previous tank container T after being detached from the previous tank container T.

As described above, the fuel supply line FL may connect one tank container T to the power generation unit G such that LNG in the one tank container T is supplied to the power generation unit G as fuel. Alternatively, the fuel supply line FL may further include an auxiliary supply line branched off of a main fuel supply line FL or a separate auxiliary supply line connected between the power generation unit G and at least two tank containers, as shown in FIG. 23, such that at least one, preferably two tank containers can be connected to the power generation unit G to fuel the power generation unit G.

Here, one tank container T connected to the main fuel supply line may be used as a main fuel supply tank and the other tank container T connected to the auxiliary fuel supply line may be used as an auxiliary fuel supply tank, such that, when supply of LNG from the main fuel supply tank to the power generation unit G is impossible, such as when LNG of the main fuel supply tank is exhausted, LNG in the auxiliary fuel supply tank can be supplied to the power generation unit G.

In this embodiment, the LNG tank container T may have a design pressure of about 8 bar to 12 bar, a maximum pressure of about 14 bar to 20 bar, and an operating pressure of about 4 bar to 8 bar. For example, the LNG tank container T may have a design pressure of about 10 bar, a maximum pressure of about 16 bar or about 18 bar, and an operating pressure of about 6 bar.

In addition, in this embodiment, a fuel supply pressure required by the power generation unit G may be lower than the operating pressure of the tank container set forth above.

For example, when the power module of the power generation unit G includes the power generation engine, a fuel supply pressure required by the power generation engine may range from about 3 bar to 8 bar. For example, the fuel supply pressure may be about 4 bar, about 3.5 bar, or about 3 bar.

According to this embodiment, the power generation unit G is provided such that the container transportation ship can be self-propelled using LNG in the tank containers T while carrying LNG using the tank containers T, and the fuel supply line FL is provided to connect the power generation unit G to a tank container T intended to supply LNG to the generation unit G such that LNG supply to the power generation unit G can be achieved without a separate delivery device or pressure device for supplying LNG from the tank container T to the power generation unit G, such as a pump.

In addition, since both the power generation unit G and the tank container T are operated at a low pressure, it is possible to establish an on-board fuel supply system at a lower cost than when a conventional marine engine system operated at a high pressure is used. Further, since the tank containers T are loaded on the deck D, that is, in an open space, rather than inside the hull and the power generation unit G is also disposed on the deck D, there is no need for any separate protective wall between the power generation unit G and the cargo space S.

In addition, the power generation unit G may be enclosed by a casing to be more safely operated.

Here, the casing may be configured to individually seal the vaporizer VP and the power generation module, may be configured to collectively seal the vaporizer VP and the power generation module, or may be configured to seal only the power generation module.

Although some embodiments have been described herein, it should be understood that these embodiments are provided for illustration only and are not to be construed in any way as limiting the present invention, and that various modifications, changes, alterations, and equivalent embodiments can be made by those skilled in the art without departing from the spirit and scope of the invention.

The scope of the present invention should be defined by the appended claims and equivalents thereof.

The invention claimed is:

1. A container transportation ship comprising:

a cargo space in which one or more containers are loaded;

a loading/unloading space which an external conveyance directly enters to load/unload the containers, the cargo space and the loading/unloading space being formed on a deck of the container transportation ship; and a crane moving the containers in longitudinal, transverse, and vertical directions of the container transportation ship to load/unload the containers onto/from the external conveyance having entered the loading/unloading space;

a reclosable door unit opening/closing an entryway through which the external conveyance enters the ship;

a guide unit guiding the external conveyance to the loading/unloading space;

a positioning unit correcting a transverse position of the external conveyance; and a stop module restricting a position of the external conveyance in a moving direction of the external conveyance.

2. The container transportation ship according to claim 1, wherein at least one of the containers loaded in the cargo space is a tank container storing liquefied gas, and the container transportation ship further comprises: a power generation unit generating electricity to be supplied to the ship; and a fuel supply line connected between the power generation unit and at least one of the tank containers to convey liquefied gas fuel from the at least one tank container to the power generation unit, the power generation unit and the fuel supply line being disposed on the deck.

3. The container transportation ship according to claim 2, wherein the fuel supply line is connected to at least one of the tank containers loaded in the cargo space, and at least one of the tank containers connected to the fuel supply line belongs to a starboardmost or portmost column of tank containers and a sternmost row of tank containers.

4. The container transportation ship according to claim 2, wherein the fuel supply line is detachably connected to the tank containers to be reconnected to another tank container when supply of liquefied gas from one tank container connected to the fuel supply line to the power generation unit is impossible.

5. The container transportation ship according to claim 1, wherein the positioning unit further comprises:

a position sensing unit detecting the transverse position of the external conveyance; and a drive unit transversely moving the external conveyance based on the position of the external conveyance detected by the position sensing unit.

6. The container transportation ship according to claim 5, wherein the guide unit comprises:

a pressing unit forcing a pair of guide modules to transversely protrude; and a support step supporting the pressing unit, wherein the pressing unit is coupled at one end thereof to each of the guide modules and is coupled at the other end thereof to the support step to adjust a transverse distance between the pair of guide modules facing each other.

7. The container transportation ship according to claim 1, further comprising:

guide rails formed at respective opposite ends of the ship parallel to the loading/unloading space to guide the crane to move in the longitudinal direction of the ship, the guide rails being formed at an upper end of an outer wall of the ship or on the deck of the ship.

8. The container transportation ship according to claim 1, wherein the crane comprises:

a container holder formed corresponding to an upper surface of the container to hold the container;

right and left columns coupled to guide rails formed at respective opposite ends of the ship, the right and left columns being movable on the guide rails;

a bridge connected between upper ends of the right and left columns to be supported by the right and left columns, the bridge being movable along with the right and left columns;

a horizontally movable part coupled to the bridge to move the container holder between the right and left columns; and a vertically movable part coupled to the horizontally movable part to vertically move the container holder.

9. The container transportation ship according to claim 1, further comprising:

the container transportation ship including a barge-type deck and underbody to form a flat hull, at least one propeller formed on the underbody to propel the hull;

a power generation unit formed at a stern on the deck to generate electricity to be supplied to the propeller;

a cargo space disposed nearer to a bow on the deck than the power generation unit and allowing one or more tank containers storing liquefied gas to be loaded therein; and a loading/unloading space disposed nearer to the bow on the deck than the cargo space and allowing an external conveyance to enter to load/unload the tank containers; and a fuel supply line connected between the power generation unit and at least one of the tank containers to convey liquefied gas fuel from the at least one tank container to the power generation unit.

10. The container transportation ship according to claim 9, further comprising:

a pilot house disposed at a right or left of the loading/unloading space to steer the ship.

11. The container transportation ship according to claim 9, wherein the power generation unit comprises:

a vaporizer regasifying liquefied gas supplied from the tank container through the fuel supply line; and a power generation module fueled by liquefied gas regasified by the vaporizer.

12. The container transportation ship according to claim 11, wherein the power generation unit is encased.

13. The container transportation ship according to claim 9, wherein the power generation unit is isolated from the loading/unloading space by the cargo space.

* * * * *